US011993884B2

(12) United States Patent
Lee et al.

(10) Patent No.: US 11,993,884 B2
(45) Date of Patent: May 28, 2024

(54) WASHING MACHINE AND METHOD OF CONTROLLING THE SAME

(71) Applicant: SAMSUNG ELECTRONICS CO., LTD., Suwon-si (KR)

(72) Inventors: Sung Mo Lee, Suwon (KR); Jun Hyun Park, Suwon (KR); Jung Chul Choi, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 705 days.

(21) Appl. No.: 16/699,244

(22) Filed: Nov. 29, 2019

(65) Prior Publication Data

US 2020/0173087 A1 Jun. 4, 2020

(51) Int. Cl.
*D06F 33/40* (2020.01)
*D06F 23/02* (2006.01)
(Continued)

(52) U.S. Cl.
CPC ..... *D06F 33/40* (2020.02); *D06F 23/02* (2013.01); *D06F 35/007* (2013.01);
(Continued)

(58) Field of Classification Search
CPC ..... D06F 33/40; D06F 23/02; D06F 35/007; D06F 2103/46; D06F 2105/48;
(Continued)

(56) References Cited

U.S. PATENT DOCUMENTS 6,240,586 B1 6/2001 Joo
7,788,755 B2 9/2010 Lee et al.
(Continued)

FOREIGN PATENT DOCUMENTS

EP 0 394 177 A2 4/1990
EP 1 045 062 A2 10/2000
(Continued)

OTHER PUBLICATIONS

Extended European Search Report dated Mar. 31, 2020, in corresponding European Patent Application No. 19212707.4.
(Continued)

*Primary Examiner* — Michael E Barr
*Assistant Examiner* — Pallavi Chitta
(74) *Attorney, Agent, or Firm* — STAAS & HALSEY LLP

(57) ABSTRACT

A washing machine of the present disclosure includes a rotating tub configured to receive laundry, a motor configured to apply a driving force to the rotating tub, a detector configured to detect electrical signal of the motor; a controller configured to receive the electrical signal detected by the detector for a predetermined time when the speed of the motor during a dehydration stroke is a predetermined speed, obtain an average value of the electrical signal received during the predetermined time, check a ripple value in the received electrical signal, obtain an eccentric value corresponding to the obtained average value and the ripple value, and control an operation of the motor to stop or maintain the dehydration stroke based on the obtained eccentric value and a driver configured to drive the motor in respond to a control command of the controller.

11 Claims, 16 Drawing Sheets

(51) Int. Cl.
*D06F 35/00* (2006.01)
*D06F 103/46* (2020.01)
*D06F 105/48* (2020.01)
*D06F 105/56* (2020.01)

(52) U.S. Cl.
CPC ..... *D06F 2103/46* (2020.02); *D06F 2105/48* (2020.02); *D06F 2105/56* (2020.02)

(58) Field of Classification Search
CPC .. D06F 2105/56; D06F 34/16; D06F 2105/46; D06F 33/48; D06F 37/22; D06F 37/304; Y02B 40/00
See application file for complete search history.

(56) References Cited

U.S. PATENT DOCUMENTS

| | | | | |
|---|---|---|---|---|
| 8,122,549 | B2 | 2/2012 | Park et al. | |
| 2004/0211009 | A1 | 10/2004 | Murray et al. | |
| 2007/0039104 | A1* | 2/2007 | Lee | D06F 34/16 68/23.1 |
| 2008/0289118 | A1* | 11/2008 | Park | D06F 33/48 68/12.02 |
| 2015/0211168 | A1* | 7/2015 | Bonlender | D06F 37/225 8/137 |
| 2017/0247826 | A1* | 8/2017 | Takashima | D06F 33/36 |
| 2018/0187357 | A1* | 7/2018 | Kawaguchi | D06F 34/14 |

FOREIGN PATENT DOCUMENTS

| | | | | |
|---|---|---|---|---|
| EP | 1045062 | B1 * | 12/2003 | D06F 33/00 |
| EP | 1 760 182 | A2 | 3/2007 | |
| EP | 3 305 962 | A1 | 4/2018 | |
| KR | 19990047936 | A * | 7/1999 | |
| KR | 10-2000-0061465 | | 10/2000 | |
| KR | 10-2007-0021788 | | 2/2007 | |
| KR | 10-2009-0021948 | | 3/2009 | |
| KR | 10-1555588 | | 5/2014 | |
| KR | 10-2018-0038727 | | 10/2015 | |
| KR | 10-2018-0017179 | | 2/2018 | |

OTHER PUBLICATIONS

Office Action dated May 19, 2023, in Korean Patent Application No. 10-2018-0151879.

* cited by examiner

WASHING MACHINE AND METHOD OF CONTROLLING THE SAME

CROSS-REFERENCE TO RELATED APPLICATION

This application is based on and claims priority under 35 U.S.C. § 119 to Korean Patent Application No. 10-2018-0151879, filed on Nov. 30, 2018, in the Korean Intellectual Property Office, the disclosure of which is incorporated by reference herein in its entirety.

BACKGROUND

1. Technical Field

Embodiments of the disclosure relate to a washing machine and a method of controlling the same to detect and determine the occurrence of eccentricity.

2. Description of Related Art

The washing machine supplies washing water to a tank containing laundry and dissolves the detergent in the washing water so that contaminants on the laundry are removed by chemical reaction with the detergent. As the laundry tank containing the laundry is rotated, the washing water and the laundry cause mechanical friction or vibration, so that the contaminants of the laundry can be easily removed.

Such a washing machine is a process for removing contaminants from laundry, and performs washing, rinsing, and dehydrating strokes. The washing machine dehydrates the washing stroke and the rinsing stroke to remove water contained in the laundry, and then performs the next stroke.

The dehydration stroke is made by centrifugal force acting on the laundry inside the washing tank by the high speed rotation of the motor, and it uses the principle that the water inside the laundry is removed from the laundry.

Accordingly, it is difficult to rotate at a high speed during the dehydration stroke, and when the laundry is entangled to one side, unbalance occurs, which causes vibration in the washing machine; and the washing machine is damaged by the vibration.

SUMMARY

One aspect provides a washing machine and a control method thereof for detecting and determining an eccentricity based on an average value of an electrical signal of a motor and a ripple value of an electrical signal of a motor.

Another aspect provides a washing machine and a control method thereof for detecting and determining an eccentricity based on an average value of a current applied to a motor and a ripple value of a current when the washing tank rotates at a speed between the first and second synchronous speeds.

In accordance with an aspect of the disclosure, a washing machine may include a rotating tub configured to receive laundry; a motor configured to apply a driving force to the rotating tub; a detector configured to detect electrical signal of the motor; a controller configured to receive the electrical signal detected by the detector for a predetermined time when the speed of the motor during a dehydration stroke is a predetermined speed, obtain an average value of the electrical signal received during the predetermined time, check a ripple value in the received electrical signal, obtain an eccentric value corresponding to the obtained average value and the ripple value, and control an operation of the motor to stop or maintain the dehydration stroke based on the obtained eccentric value; and a driver configured to drive the motor in respond to a control command of the controller.

The controller may control the operation of the motor to stop when the obtained eccentric value is equal or larger than a predetermined value to stop the dehydration stroke, and may control the operation of the motor to accelerate when the obtained eccentric value is less than the predetermined value to maintain the dehydration stroke.

The controller may control the speed of the motor as an acceleration control for the resonance operation to perform a resonance operation when the obtained eccentric value is less than the predetermined value.

The controller may control the speed of the motor to a speed for a high speed rotation operation to perform the present dehydration stroke when the obtained eccentric value is less than the predetermined value.

The controller may determine a diagonal eccentricity has occurred when the obtained eccentricity is greater than or equal to a preset value.

The controller may control the operation of the motor to detect the weight of the laundry, and controls the speed of the motor to the predetermined speed when the weight is detected.

The rotating tub may be disposed horizontally inside a case and includes an inlet provided in the front, and the controller may accelerate the speed of the motor to the predetermined speed when performing the eccentric detection operation.

The rotating tub may be disposed vertically inside a case and includes an inlet provided in the upper portion, and the controller may accelerate the speed of the motor to the predetermined speed to detect the eccentricity before performing the second resonant operation when the first resonant operation is completed.

The speed of the motor when performing the second resonant operation may be faster than the speed of the motor when performing the first resonant operation, and the predetermined speed may be faster than the speed of the motor when performing the first resonant operation.

The detector may be include a current detector detecting a current flowing in the motor, and the electrical signal may be a current signal corresponding to the current detected by the current detector.

The detector may include a voltage detector detecting a voltage applying in the motor, and the electrical signal may be a voltage signal corresponding to the voltage detected by the voltage detector.

The detector may include a current detector detecting a current flowing in the motor and a voltage detector detecting a voltage applying in the motor, and the electrical signal may include a current signal corresponding to the current detected by the current detector and a voltage signal corresponding to the voltage detected by the voltage detector.

The ripple value may include the highest ripple value of the ripple values of the electrical signal received during the predetermined time.

The predetermined speed may include a speed between 100 rpm and 150 rpm.

In accordance with another aspect of the disclosure, a control method of a washing machine including a motor applying a driving force to a rotating tub, the method comprising: checking a speed of the motor during dehydration stroke; checking an electrical signal of the motor detected by a detector fora predetermined time when the speed of the motor is a predetermined speed; obtaining an average value of the electrical signal received during the predetermined time, checking a ripple value in the received electrical signal, obtaining an eccentric value corresponding to the obtained average value and the ripple value; stopping the dehydration stroke when the obtained eccentric value is equal or larger than a predetermined value; and maintaining the dehydration stroke when the obtained eccentric value is less than the predetermined value.

The method may further include stopping the dehydration stroke and performing the dehydration stroke again when a set time elapses.

The method may further include maintaining the dehydration stroke comprises accelerating the speed off the motor to a speed for a high speed rotation operation.

The method may further include the electrical signal includes a current signal corresponding to the current detected by the detector.

The method may further include the electrical signal includes at least one of a current signal corresponding to the current detected by the detector and a voltage current corresponding to the voltage detected by the detector.

The method may further include checking the ripple value comprises checking the highest ripple value of the ripple values of the electrical signal received during the predetermined time.

The present disclosure is to determine whether the laundry is diagonally eccentric by using the current value generated during the rotation of the washing tank at the beginning of the dehydration stroke, and then to maintain or stop the dehydration stroke according to the diagonal eccentricity. By quickly detecting and judging and responding quickly to the diagonal eccentricity, it is possible to prevent the operation time of the dehydration stroke from increasing, thereby preventing the increase of the energy consumed in the washing machine.

In addition, the present disclosure can reduce the vibration noise due to the fast diagonal eccentric detection and determination, thereby preventing damage to the washing machine.

The present disclosure can prevent an increase in manufacturing cost by determining whether a diagonal eccentricity is generated without adding additional hardware such as a vibration sensor.

In addition, the present disclosure can improve the quality and merchandise of the washing machine and further increase the user's satisfaction, improve the stability of the washing machine and ensure the competitiveness of the product.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION OF THE EMBODIMENTS

Figure 1:
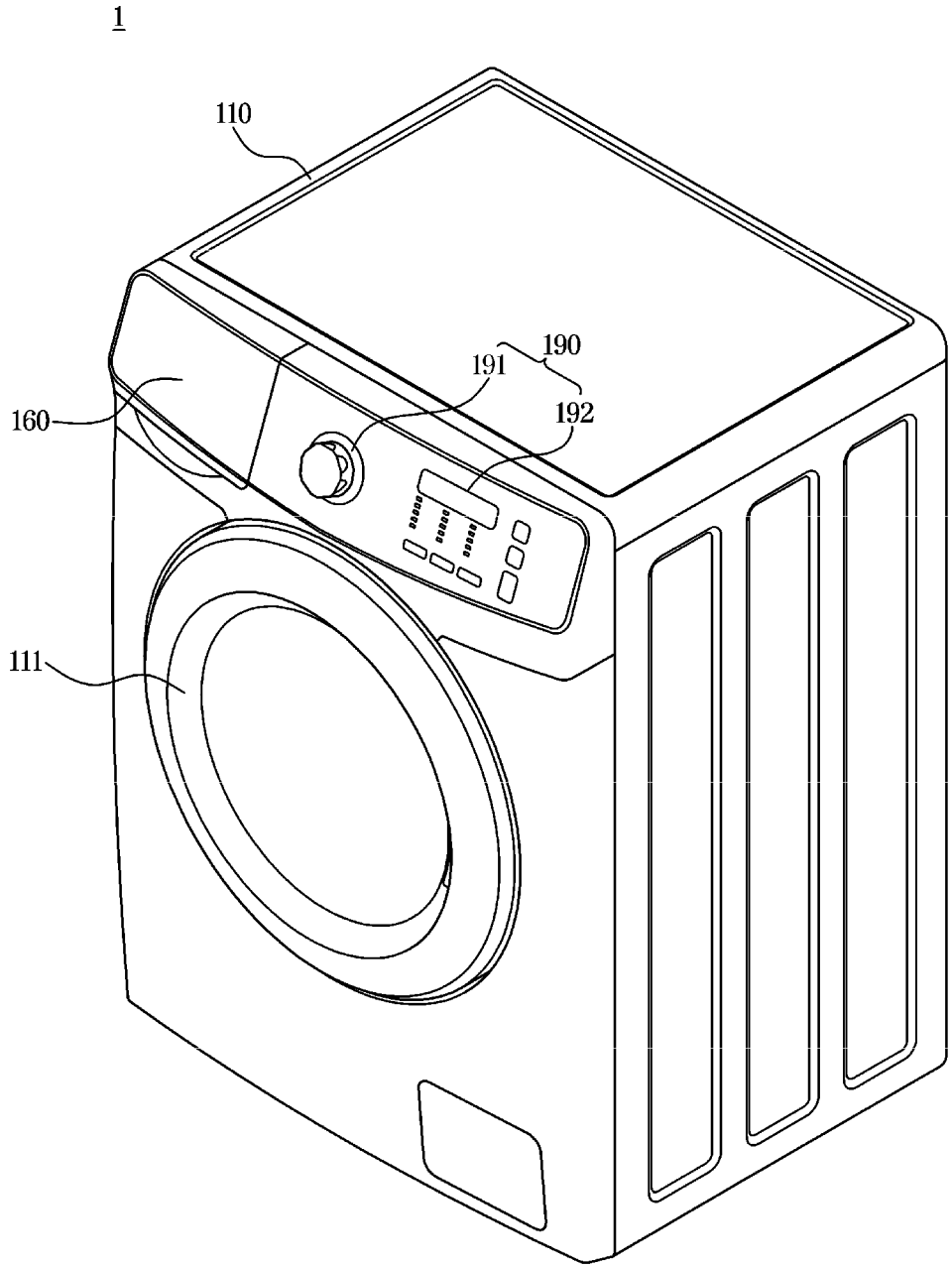
FIG. 1 is an external view of a washing machine according to one embodiment.

Reference will now be made in detail to the embodiments of the present disclosure, examples of which are illustrated in the accompanying drawings, wherein like reference numerals refer to like elements throughout. This specification does not describe all elements of the embodiments of the present disclosure and detailed descriptions on what are well known in the art or redundant descriptions on substantially the same configurations may be omitted.

The terms 'unit, module, member, and block' used herein may be implemented using a software or hardware component. According to an embodiment, a plurality of 'units, modules, members, or blocks' may also be implemented using an element and one 'unit, module, member, or block' may include a plurality of elements.

Throughout the specification, when an element is referred to as being "connected to" another element, it may be directly or indirectly connected to the other element and the "indirectly connected to" includes being connected to the other element via a wireless communication network.

Also, it is to be understood that the terms "include" and "have" are intended to indicate the existence of elements disclosed in the specification, and are not intended to preclude the possibility that one or more other elements may exist or may be added.

In this specification, terms "first," "second," etc. are used to distinguish one component from other components and, therefore, the components are not limited by the terms.

An expression used in the singular encompasses the expression of the plural, unless it has a clearly different meaning in the context.

The reference numerals used in operations are used for descriptive convenience and are not intended to describe the order of operations and the operations may be performed in a different order unless otherwise stated.

Hereinafter, embodiments of the present disclosure will be described in detail with reference to the accompanying drawings.

The washing machine according to an embodiment will be described with respect to a front loading washing machine in which a rotating tub is disposed horizontally and a front laundry inlet is formed.

The washing machine 1 of one embodiment may further perform a drying stroke in addition to the washing, rinsing and dehydrating strokes.

Figure 2:
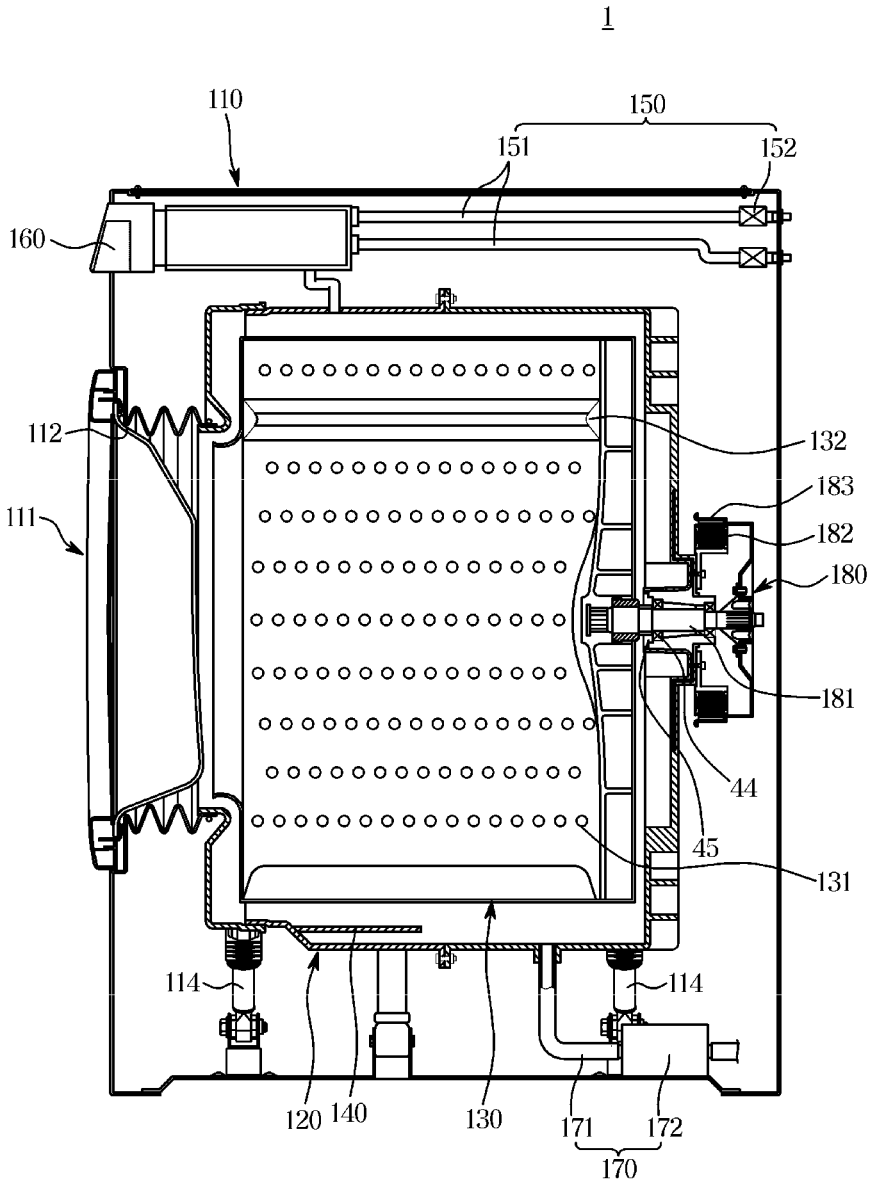
FIG. 2 is a cross-sectional view of a washing machine according to one embodiment.
Figure 3:
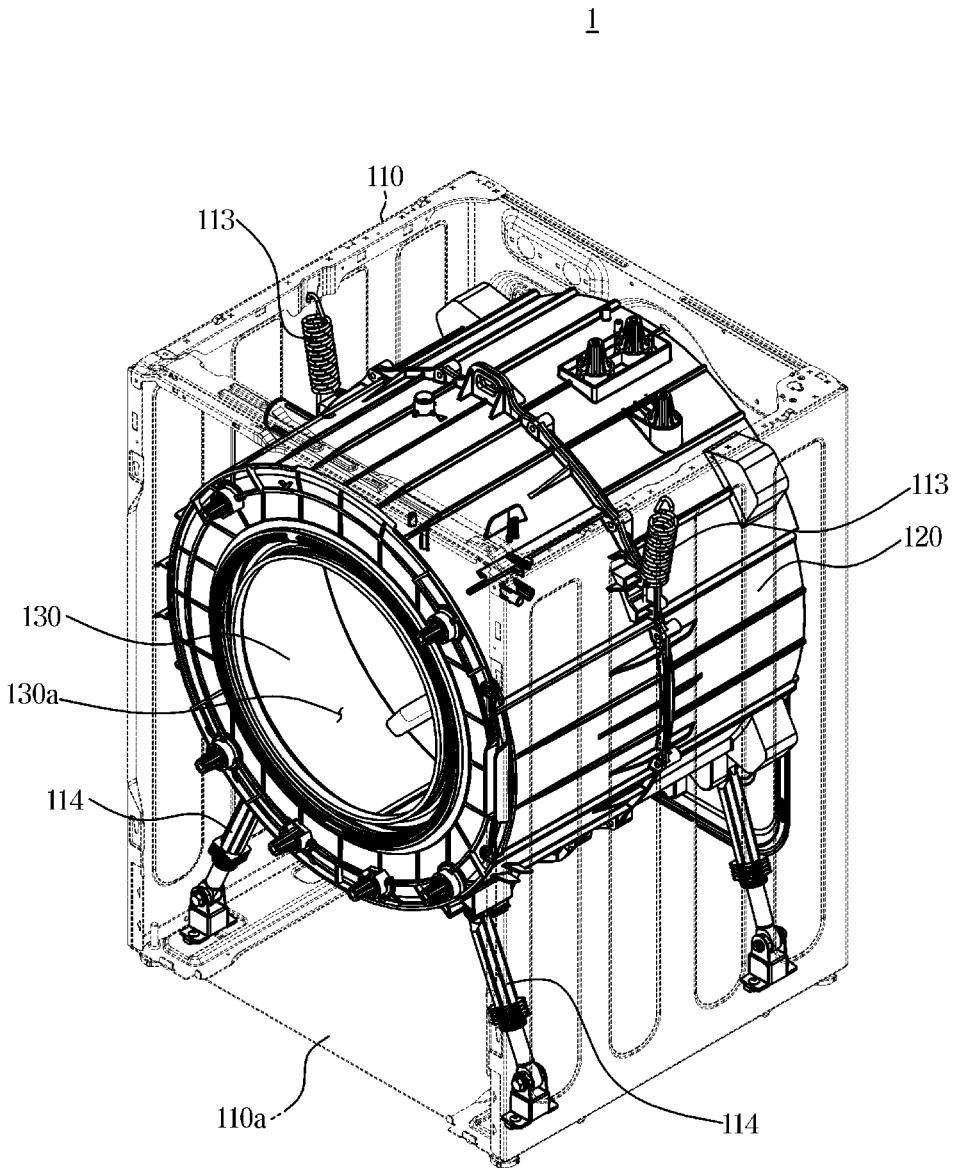
FIG. 3 is an internal perspective view of a washing machine according to one embodiment.

FIG. 1 is an external view of a washing machine according to one embodiment, FIG. 2 is a cross-sectional view of a washing machine according to one embodiment; and FIG. 3 is an internal perspective view of a washing machine according to one embodiment shown in FIG. 1.

As shown in FIG. 1 and FIG. 2, a washing machine 1 includes a cabinet 110, a water tank 120, a rotating tub 130, a heater 140, a water supplier 150, a detergent supplier 160, a drain 170, and a motor 180.

The cabinet 110 forms an exterior of the washing machine 1, and an opening is formed at one side to input and take out laundry.

The cabinet 110 is equipped with a door 111 for opening and closing the opening, and a gasket 112 for sealing between the door 111 and the opening is mounted on a circumferential surface of the opening.

At this time, a direction in which one surface on which the opening of the washing machine 1 is formed is located, referred to as front, and the direction in which the other surface opposite to the one surface on which the opening is formed is located may be referred to as the rear side.

The water tank 120 is fixedly installed in the cabinet 110 and receives water supplied from the water supplier 150. This water tank 120 is also called tub.

The outer side of the water tank 120 is equipped with a motor 180 for rotating the rotating tub 130. The rotating tub 130 is also referred to as the drum.

As shown in FIG. 3, the washing machine 1 may further include an elastic member 113 connecting the upper inner surface of the cabinet 110 and the water tank 120. The elastic member 113 may serve as a suspension for preventing vibration or shock transmitted to the water tank 120 from being transmitted to the cabinet 110.

As shown in FIG. 2, the rotating tub 130 is located in the interior of the water tank 120 in a shape corresponding to the shape of the water tank 120. The rotating shaft 181 of the motor is connected to the outside of the rotating tub 130, the rotating shaft 181 of the motor may extend to the outside of the water tank 120. The rotating shaft 181 of the motor transmits the driving force of the motor 180 to the rotating tub 130.

Accordingly, the rotating tub 130 may rotate clockwise or counterclockwise in the water tank 120 by the driving force of the motor 180.

One side of the rotating tub 130 is formed with an inlet (130*a*), the other side is formed with a plurality of holes (131). The rotating tub 130 accommodates laundry through the inlet 130*a* when the door 111 is opened, and allows water to flow through the plurality of holes 131 formed on the remaining surface.

That is, the plurality of holes 131 allow the water in the water tank 120 to be introduced into the rotating tub 130, and also allow the water in the rotating tub 130 to be discharged to the water tank 120.

A plurality of lifters 132 may be installed on the inner circumferential surface of the rotating tub 130 to allow the laundry to rise and fall when the rotating tub 130 rotates.

In addition, the plurality of lifters 132 may protrude from the inner circumferential surface of the rotating tub 130.

As shown in FIG. 3, the washing machine 1 may further include a damper 114 connecting the water tank 120 and the inner surface of the base 100*a* positioned under the cabinet 110. There may be four dampers 114 in this embodiment. The number of such dampers is not limited.

When the rotating tub 130 is rotated by the rotating shaft 181 of the motor 180, the water tank 120 may be transmitted to the vibration or shock by the rotating rotating tub 130. Vibration or shock applied to the water tank 120 may be dampened by the damper 114 to reduce the vibration or shock delivered to the cabinet 110.

Thus, a plurality of dampers 114 is provided to be fixed to the outer surface of the water tank 120 and the inner surface of the base (110*a*), and as the rotating tub 130 rotates, the vibration or shock received by the water tank 120 is buffered by the plurality of dampers 114, and vibration or shock transmitted to the base (100*a*) side can be reduced.

The damper 114 may be a hydraulic damper filled with fluid therein, or may be a friction damper in which a damping effect may occur due to the frictional force of the friction member provided therein. The kind of damper 114 is not limited to the said base material.

As shown in FIG. 3, the washing machine 1 may further include a heater 140 provided in the water tank 120 to heat water in the water tank 120. The heater 140 may include at least one heater.

The washing machine 1 may further include a temperature detector (not shown) for sensing the temperature of the heated water, and may control the operation of the heater 140 based on the temperature of the water detected by the temperature detector.

The washing machine 1 may further include a temperature detector (not shown) for sensing the temperature of the heated water, and may control the operation of the heater 140 based on the temperature of the water detected by the temperature detector.

The water supplier 150 includes a water supply pipe 151 and a water supply valve 152.

Here, one end of the water supply pipe 151 may be connected to an external water pipe (not shown), and the other may be connected to the detergent supplier 160.

The water supply pipe 151 receives water from an external water pipe and guides it into the detergent supplier 160.

The water supply pipe 151 may be connected between the detergent supplier 160 and the water tank 120. The water supply pipe 151 guides the water supplied from the external water pipe into the water tank 120 and the rotating tub 130 together with the detergent of the detergent supplier 160.

The water supply valve 152 is opened and closed during the washing and rinsing stroke to adjust the amount of water supplied into the water tank 120 and the rotating tub 130.

In addition, the washing machine can supply high temperature water and wash the laundry using the supplied hot water.

The detergent supplier 160 stores detergents committed by the user. That is, the detergent supplier 160 may store at least one of a synthetic detergent, a fabric softener, and a bleach.

The detergent supplier 160 allows the introduced water to flow out into the water supply pipe 151 together with the detergent when water is introduced through the water supply pipe 151 during the washing stroke.

The drain 170 includes a drain pipe 171 and a drain pump 172.

The drain pipe 171 may be provided below the water tank 120.

The drain pump 172 pumps water inside the water tank 120 and the rotating tub 130 during the drainage and dehydration stroke. That is, the water pump 172 is introduced into the water tank 120 and the rotating tub 130 when the pump is pumped along the drain pipe 171 and guides the introduced water to the outside through the drain pipe 171 to the inside of the water tank 120 and the rotating tub 130 to be discharged to the outside.

The motor 180 is driven at the time of detecting the weight of the laundry, at the washing stroke, at the rinsing stroke, at the dehydration stroke, and at the drying stroke, and by rotating the rotating tub 130 with the driving force, the laundry contained in the rotating tub 130 is washed, rinsed, dehydrated and dried.

The motor 180 may generate a driving force from the power of an external power source, and transmit the generated driving force to the rotating tub 130 through the rotating shaft 181 as a rotating force.

The motor 180 further includes a stator 182 and a rotor 183 in addition to the rotation shaft 181.

One end of the rotating shaft 181 is fixed to the rotor 183 and the other end is fixed to the rotating tub 130 through the water tank 120. That is, the rotating shaft 181 may be rotatably installed through the water tank 120.

The stator 182 is fixed and installed to the rear of the water tank 120. And the rotor 183 is installed on the outside of the stator 182 to rotate in interaction with the stator 182.

The motor 180 may employ a brushless direct current motor (BLDG motor) or a synchronous motor that can easily control the rotation speed. In addition, the motor 180 may employ a low-cost direct current motor (DC motor) or induction motor (induction motor).

The washing machine further includes a control panel 190 for interfacing with the user.

The control panel 190 may include an input 191 for receiving an operation command and a display 192 for displaying operation information of the washing machine.

The input 191 may include a plurality of buttons for receiving a start, pause, and stop command, and may further include a jog dial for receiving a laundry program. In addition, the input for receiving the laundry program may be provided as a button type.

The laundry program may include standard laundry, duvet laundry, boil, wool laundry, towel laundry, rapid laundry, and the options may include at least one of the amount of water, the temperature of the water, the time of the washing stroke, the number of rinsing strokes, the intensity of the dehydration stroke and the time of the dehydration stroke.

In addition, the input 191 may further include a button for receiving an option.

The options here may include at least one of the amount of water, the temperature of the water, the time of the washing stroke, the number of rinsing strokes, the intensity of the dehydrating stroke and the time of the dehydrating stroke. In addition, when a drying stroke is possible in the washing machine, the option may further include a drying degree.

The display 192 may display operation information of the washing machine, display remaining time during the operation, and display a washing program and options selected by the user.

The display 192 may display whether or not to perform the washing and may also display an error code corresponding to the washing impossible.

The display 192 includes a plurality of seven segments.

The display 192 may include a flat panel display such as a liquid crystal display (LCD), and may further include a light emitting diode (LED).

Figure 4:
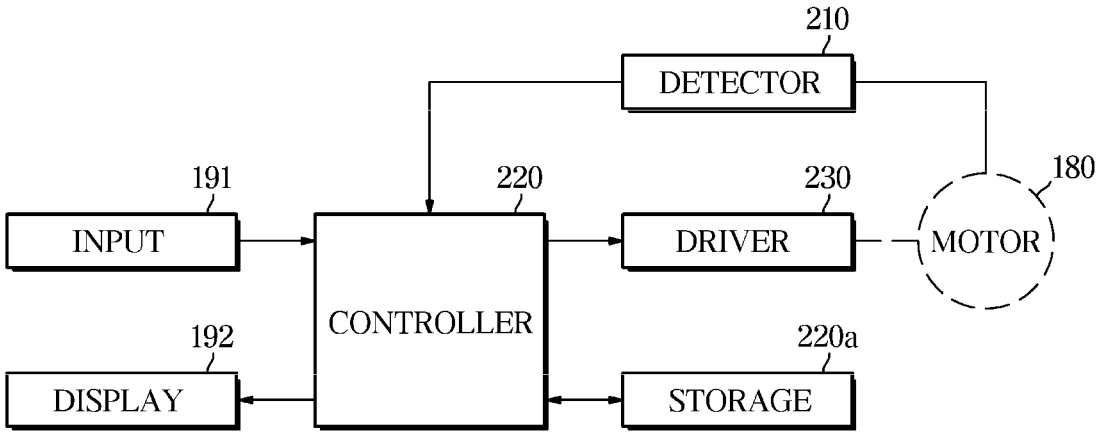
FIG. 4 is a control block diagram of a washing machine according to one embodiment.

FIG. 4 is a control block diagram of a washing machine according to an embodiment.

As shown in FIG. 4, the washing machine 1 includes an input 191, a display 192, a detector 210, a controller 220, a storage 220*a*, and a driver 230.

The input 210 receives an operation command from the user.

The input 191 is also capable of receiving start, pause and stop commands, input of a wash program and further options.

The display 220 displays information related to the state or operation of the washing machine 1, displays information input to the input 210, and displays information for guiding the user's input.

The detector 210 detects an electrical signal applied to the motor 180 to recognize the operation information of the motor 180 and outputs the detected electrical signal.

The operation information of the motor may include at least one of a current applied to the motor 180, a voltage applied to the motor 180, and power of the motor. That is, the electrical signal may include at least one of a current signal, a voltage signal, and a power signal.

The detector 210 may include a current detector (see FIGS. 5 and 8, 211) for detecting a current applied to the motor 180. The current detector may detect a current applied to the motor 180 through at least one input terminal among the three phase input terminals of the motor provided in the driver 230 and output a signal corresponding to the detected current. The signal may be a signal corresponding to the value of the current applied to the motor 180.

The detector 210 may include a voltage detector (see FIGS. 8 and 212) for detecting a voltage applied to both ends of the motor 180. The voltage detector may detect DC voltages at both ends of the DC voltage provided in the driver 230.

The detector 210 is for detecting power of the motor 180, and may include a current detector for detecting a current applied to the motor 180, and a voltage detector for detecting a voltage applied to both ends of the motor 180.

The controller 220 controls the overall operation of the washing machine 1.

The controller 220 controls the operation of the washing machine based on the weight of the laundry, the washing program and the options input to the input 191.

The controller 220 controls the operation of the water supplier 150, the heater 140, and the drain 170 when controlling the operation of the washing machine, and controls the operation of the motor 180 to perform the washing stroke, the rinsing stroke, dehydrating stroke, the drying stroke corresponding to the selected laundry program and at least one option.

The controller 220 may control the heater 140 based on the temperature of the water selected through the input unit during the washing stroke and the rinsing stroke control.

The controller 220 controls the operation of the display 192 to display the laundry program selected by the user and at least one option through the input 191.

More specifically, the controller 220 checks the weight of the laundry corresponding to the sensing information detected by the weight detector (not shown) when the laundry program is executed, and controls the washing stroke and rinsing stroke while adjusting the water supply amount based on the identified laundry weight and the washing program selected by the user, and controls the dehydration stroke based on the weight of the laundry identified and the laundry program.

The controller 220 controls the operations of the water supplier 450, the motor 180, the heater 440, and the drain 470 during the washing stroke and the rinsing stroke control, and controls the operations of the motor 180 and the drain 170 during the dehydration stroke control.

The controller 220 may control the operation of the motor 180 and the heater 140 during the drying stroke.

The controller 220 causes the rotating tub 130 to rotate while controlling the speed of the motor 180 based on the selected washing program and at least one option when performing at least one of a washing stroke, a rinsing stroke, a dehydration stroke and a drying stroke.

The controller 220 estimates the position of the rotor based on the current and voltage command detected by the current detector 211 and obtains the speed of the motor based on the estimated position of the rotor.

The controller 220 controls the speed of the motor 180 to perform an intermediate dehydration stroke after the washing stroke and the rinsing stroke are completed, and after both the washing stroke and the rinsing stroke are completed, the speed of the motor 180 is controlled to perform the final dehydrating stroke.

When the controller 220 controls the speed of the motor 180, the controller 220 receives a current supplied to the motor 180 detected by the current detector 211, and controls the speed of the motor 180 based on the comparison result between the detected current and the target current.

The configuration of the controller 220 for controlling the speed of the motor will be described with reference to FIG. 5.

Figure 5:
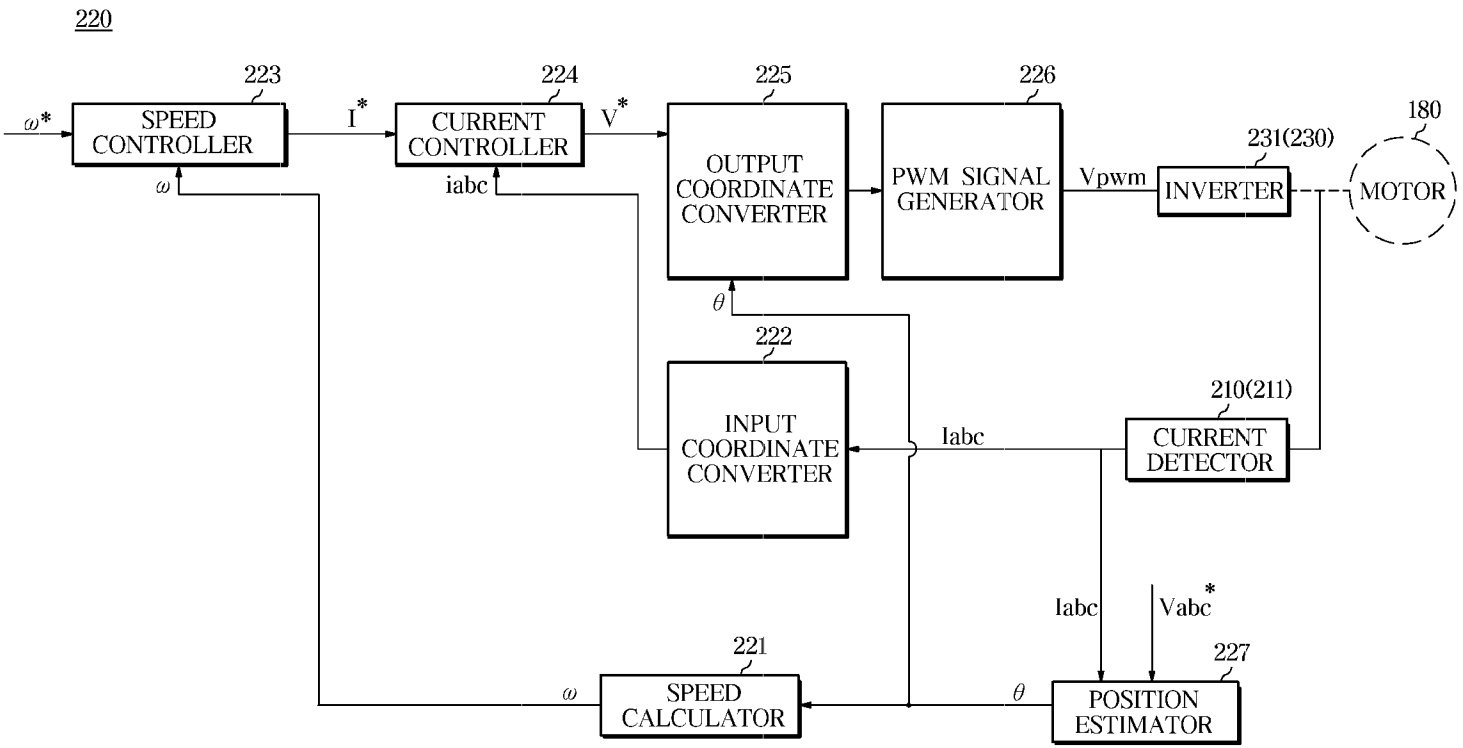
FIG. 5 is a detailed block diagram illustrating a control unit provided in a washing machine according to an embodiment.

Referring to FIG. 5, the controller 220 includes a speed calculator 221, an input coordinate converter 222, a speed controller 223, a current controller 224, an output coordinate converter 225, a PWM signal generator 226, and a position estimator 227.

The speed calculator 221 obtains the rotational speed w of the motor based on the position θ of the rotor estimated by the position estimator 227.

The input coordinate converter 222 converts the a, b and c phase currents detected by the current detector 211 into d-axis current and q-axis current based on the position θ of the rotor of the motor.

The speed controller 223 compares the target speed (or speed command ω*) input from the outside with the rotational speed w of the motor, and outputs a current command I* according to the comparison result.

The speed controller 223 may include a proportional controller (P), a proportional integral controller (PI), or a proportional integral derivative controller (RD).

The current controller 224 compares the current command I* output from the speed controller 223 with the current Iabc of the motor, and outputs a voltage command V* according to the comparison result.

The current controller 224 compares the q-axis current command output from the speed controller 223 with the q-axis current of the motor, and outputs the q-axis voltage command according to the comparison result, obtains D-axis current command based on the rotational speed (ω) of the motor, and the position (θ) of the rotor of the rotor, and compares the d-axis current command with the d-axis current of the motor, and outputs the d-axis voltage command according to the comparison result.

Here, the d-axis current may be a current of the magnetic flux component, and the q-axis current may be a current of the torque component.

The current controller 224 may also include a proportional controller, a proportional integral controller, or a proportional integral derivative controller.

The output coordinate converter 225 converts the d-axis voltage command and the q-axis voltage command into a, b, and c-phase voltage commands Vabc* based on the position θ of the rotor.

The PWM signal generator 226 generates a control signal VPWM to be provided to the inverter 231 based on the a, b, and c phase voltage commands Vabc*.

Specifically, pulse width modulation (PWM) is performed for each of the a, b and c phase voltage commands Vabc*, and therefore the control signal VPWM for turning on/off the plurality of switching circuits Q11 to Q13 and Q21 to Q23 of the inverter 231 is output.

The position estimator 227 is possible to estimate the position of the rotor θ based on the current Iabc detected by the current detector 211 and the voltage command Vabc* output from the output coordinate converter 225.

In addition, the washing machine can also detect the position of the rotor using a position detector (not shown).

The controller 220 controls the operation of the motor by converting the a-phase, b-phase and c-phase of the motor into the d-axis and q-axis.

Specifically, the controller 220 converts the a-phase, b-phase and c-phase currents of the motor into d-axis and q-axis currents, and converts the a-phase, b-phase and c-phase voltages into d- and q-axis voltages.

Here, the d-axis refers to the axis of the direction coinciding with the direction of the magnetic field generated by the rotor of the motor, the q-axis refers to the axis of 90 degrees ahead of the direction of the magnetic field generated by the rotor.

Here, 90 degrees refers to an electric angle obtained by converting the angle between adjacent N poles included in the rotor or the angle between adjacent S poles to 360 degrees, not the mechanical angle of the rotor.

The controller 220 generates a pulse width modulation signal VPWM based on the current Iabc detected by the current detector 211, the rotational speed w of the rotor, and the voltage command Vabc* output from the output coordinate converter 225.

That is, the controller 220 calculates a current command to be applied to the motor based on the rotation speed w of the motor and the detected current Iabc, and calculates a voltage command to be applied to the motor 180 based on the current command, and generates a pulse width modulation (PWM) signal VPWM based on the calculated voltage command.

The controller 220 controls the current applied to the motor 180 by controlling the on/off of the inverter of the driver based on the pulse width modulated signal so that the motor rotates at a speed corresponding to the adjusted current.

Figure 6:
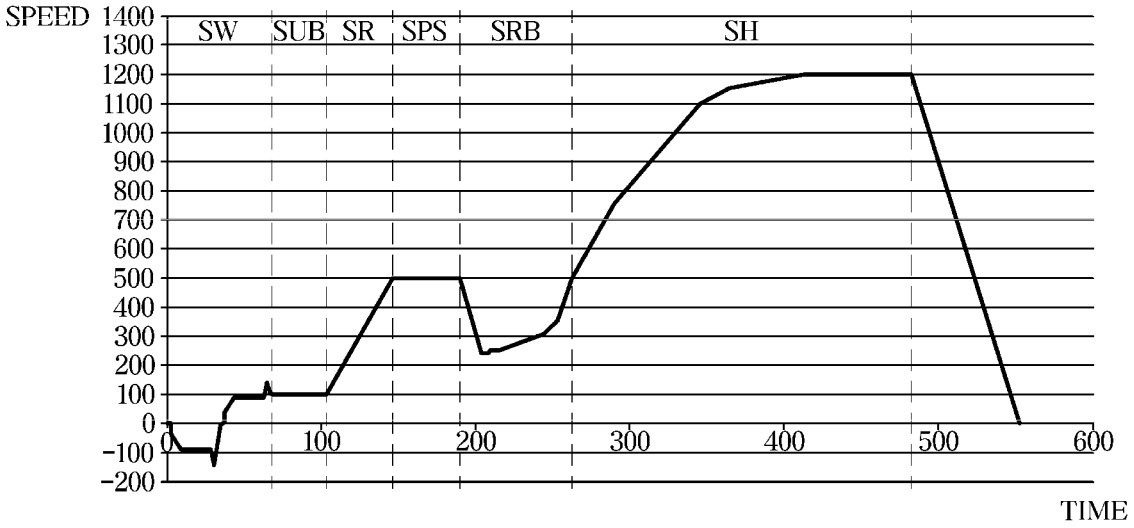
FIG. 6 is a diagram illustrating a detailed operation of the dehydration stroke of the washing machine according to an embodiment.

As shown in FIG. 6, the controller 220 performs, when dehydration strokes such as an intermediate dehydration stroke and a final dehydration stroke, a weight sensing operation (SW) to detect the weight of the laundry, an eccentricity detection operation (SUB) to detect the eccentricity of the laundry, a resonance operation (SR) generated by the vibration of the rotating tub, a free spin operation (SFS) for preliminary spin spinning, a rebalancing (SRB) to distribute the laundry in a rotating bath, and a high speed rotation operation (SH) for the spin dehydration.

In order to perform the weight sensing operation (SW), after rotating the motor 180 at a first speed for a predetermined time, the rotation of the motor 180 is stopped, and at this time, the weight of the laundry is detected based on the generated counter electromotive force.

The controller 220 controls the rotation of the motor 180 after the weight sensing operation is completed to perform an eccentric sensing operation (SUB) during the dehydration stroke. And the operation of the motor 180 is controlled to increase the rotation speed of the motor 180 at the second speed.

The controller 220 detects an eccentricity value based on an electrical signal applied to the motor 180 among the eccentric detection operations SUB, and determines whether an eccentricity is generated based on the detected eccentric value. Here, the eccentric value includes an eccentric value due to a diagonal eccentricity.

An example of the eccentric type will be described with reference to FIGS. 7A, 7B and 7C.

Figure 7A:
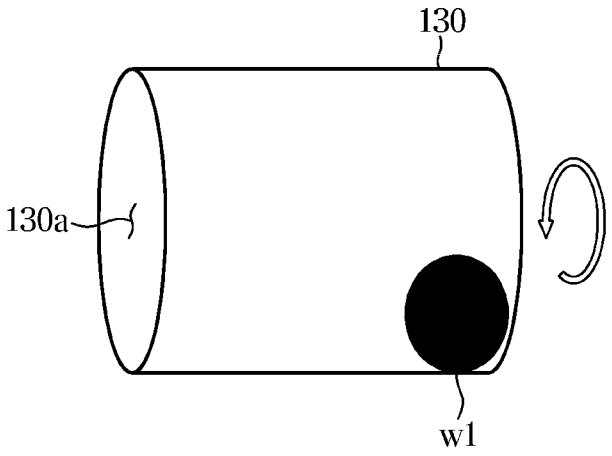
FIGS. 7A, 7B and 7C are eccentric views of the washing machine according to one embodiment.

As shown in FIG. 7A, the general eccentricity is an eccentricity generated when the laundry w1 is positioned at the rear side of the rotating tub 130, that is, on the first side of the surface facing the inlet 130*a*.

Figure 7B:
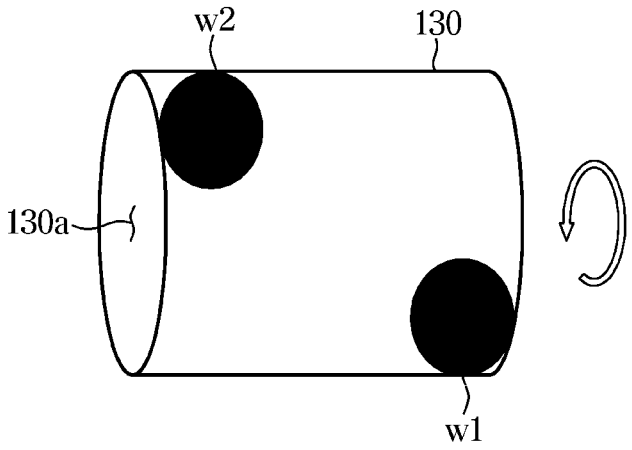

As shown in FIG. 7B, diagonal eccentricity is an eccentricity when Laundry (w1) is located on the rear side of the rotating tub 130, that is, the first side of the surface facing the inlet (130*a*), and when the laundry w2 is positioned in front of the rotating tub 130, that is, on the second side of the surface adjacent to the inlet 130*a*. Here, the first side and the second side may be diagonal to each other.

In other words, the second side may be a position having a direction of about 45 degrees from the first side with respect to the horizontal line extending from the first side. The horizontal line may be a line parallel to the horizon.

Figure 7C:
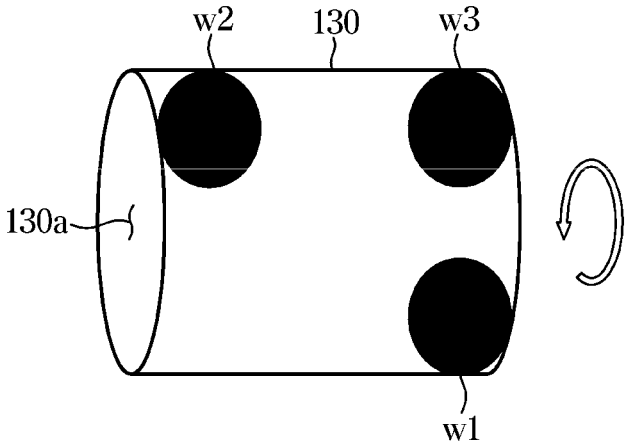

As shown in FIG. 7C, diagonal eccentricity is an eccentricity when Laundry (w1, w3) is located on the rear side of the rotating tub 130, that is, the first side of the surface facing the inlet (130*a*), and when the laundry w2 is positioned in front of the rotating tub 130, that is, on the second side of the surface adjacent to the inlet 130*a*. Here, the first side and the second side may be diagonal to each other.

That is, the diagonal eccentric may include an eccentricity generated when the direction diagonal to each other, the laundry of any one of the laundry (w1, w3) located in the two parts of the first side in the rotating tub 130, the laundry (w2) is located on the second side of the surface adjacent to the inlet (130*a*).

The controller 220 controls the rotation of the motor 180 to perform a resonance operation (SR) during the dehydration stroke, and the operation of the motor 180 is controlled to increase the rotation speed of the motor 180 from the second speed to the third speed.

In the case of a front loading washing machine, four dampers are arranged, and thus, one vibration may be performed during the dehydration stroke because vibration is smaller than that of the top loading washing machine.

The controller 220 controls the operation of the motor 180 such that the rotational speed of the motor 180 is maintained at the third speed in order to perform the free spin operation (SPS) during the dehydration stroke.

The controller 220 controls the operation of the motor 180 to reduce the rotational speed of the motor 180 from the third speed to the fourth speed in order to perform a rebalancing operation (SRB) during the dehydration stroke to make sure the laundry is distributed evenly inside the rotating tub.

The controller 220 controls the operation of the motor 180 such that the rotation speed of the motor 180 is increased from the fourth speed to the fifth speed in order to perform the high speed rotation operation (SH) during the dehydration stroke. This allows the water contained in the laundry to be separated to the outside by centrifugal force.

Here, the first speed, the second speed, the third speed, the fourth speed, and the fifth speed may be preset speeds or speeds obtained by experiments.

For example, the first speed may be about 90 rpm, the second speed may be about 100 rpm, the third speed may be about 500 rpm, the fourth speed may be about 250 rpm, and the fifth speed may be about 1200 rpm.

The first speed may be a speed at which the laundry is uniformly distributed in the rotating tub.

The second speed may be approximately 150 rpm.

In addition, the first speed, the second speed, the third speed, the fourth speed and the fifth speed may be different according to the capacity of the washing machine, the motor capacity, the washing program and the options.

The controller 220 performs weight sensing during dehydration stroke, and adjusts the execution time of at least one of an eccentric detection operation (SUB), a resonance operation (SR), a free spin operation (SPS), a rebalancing operation (SRB) and a high speed rotation operation (SH) based on the detected laundry weight, and controls the operation of the motor 180 based on the adjusted at least one execution time.

In addition, the execution time of each operation corresponding to the weight of the laundry may be stored in advance.

When the controller 220 starts the dehydration stroke and performs the eccentric detection operation, the controller 220 may detect the eccentricity and determine whether the eccentricity is based on the operation information of the motor for a predetermined time. The operation information of the motor may include at least one of a voltage applied to the motor, a current flowing in the motor, and power of the motor.

More specifically, the controller 220 starts the dehydration stroke and checks the current detected by the current detector 211 when performing the eccentric sensing operation.

The controller 220 may detect the eccentricity by starting the dehydration stroke and checking the current detected by the current detector 211 before performing the resonance operation.

In the case of a front loading washing machine, four dampers are disposed, so that vibration generated during the dehydration stroke is less vibration than that of the top loading washing machine. For this reason, the speed (approximately 500 rpm) of the motor performing the resonance operation during the dehydration stroke in the front loading washing machine is higher than the speed (approximately 50 rpm) of the motor performing the resonance operation in the top loading washing machine. Therefore, the controller 220 of the front loading washing machine detects and determines the eccentricity before performing the resonance operation.

The controller 220 may also detect and determine an eccentricity by checking the current detected by the current detector 211 when the speed of the motor is a predetermined speed during the dehydration stroke. The preset speed may be approximately 150 rpm.

In addition, the preset speed may be less than approximately 150 rpm.

When the controller 220 detects the eccentricity, the controller 220 may check the current detected for a predetermined time, obtain an average value of the current detected for a predetermined time, and check the ripple value of the detected current for a predetermined time. Here, the predetermined time may be a preset time.

That is, the controller 220 receives the current signal output from the current detector 211 when checking the current detected for a predetermined time, recognizes the current value in the received current signal, and obtains an average value for the recognized current value for a certain time.

When the controller 220 acquires an average value of the detected currents for a predetermined time, the controller 220 may obtain an average value of the currents by using an integration over time.

When the controller 220 receives the current signal output through the current detector, the controller 220 checks the received current signal at a reference time interval, checks as a predetermined number, checks current values in the checked current signal, and checks the predetermined number of currents. It is also possible to obtain the average current value of the values.

When the controller 220 checks the ripple value of the current, the controller 220 receives the current signal output from the current detector 211, recognizes the ripple signal from the received current signal, and checks the current value of the recognized ripple signal. Here, the current value of the ripple signal corresponds to the ripple value of the current.

When the controller 220 checks the ripple value of the current, the controller 220 may check the highest ripple value having the largest value among the ripple values of the current detected for a certain time, and also be possible to check the smallest lowest ripple value among the ripple values of the current detected for a certain time, and also be possible to check the average ripple value of the ripple values of the current detected for a certain time.

The controller 220 obtains a diagonal eccentricity value corresponding to the ratio of the ripple value of the current and the average value of the current, and determines whether the diagonal eccentricity is based on the obtained eccentric value.

If the obtained eccentricity value is greater than or equal to the reference value, the controller 220 stops the dehydration stroke and performs the dehydration stroke again.

When the dehydration stroke is stopped, the controller 220 may stop and control the operation of the motor 180 to stop the rotation of the rotating tub.

When the controller 220 performs the dehydration stroke again, the controller 220 may perform the weight sensing operation.

When the controller 220 performs the dehydration stroke again, the controller 220 may perform an eccentricity detection operation.

The controller 220 maintains the dehydration stroke when the obtained eccentricity value is less than the reference value.

The controller 220 may control to increase the speed of the motor from the second speed to the fifth speed so that the present dehydration operation is performed when the obtained eccentric value is less than the reference value.

The controller 220 may obtain an eccentric value corresponding to the ratio of the ripple value of the current and the average value of the current, and determine the type of eccentricity based on the obtained eccentric value.

The controller 220 may determine the diagonal eccentricity if the obtained eccentricity value is greater than or equal to a preset value. The preset value may be a value smaller than the reference value.

The controller 220 may display the type of generated eccentricity through the display unit so that the user can recognize the type of eccentricity.

The controller 220 may output the sound through a speaker (not shown) so that the user may recognize the type of the generated eccentricity.

The controller 220 starts the dehydration stroke and checks the voltage detected by the voltage detector 212 when performing the eccentric sensing operation.

The controller 220 may also detect and determine an eccentricity by checking the voltage detected by the voltage detector 212 before performing the resonance operation.

The controller 220 may also detect and determine an eccentricity by checking the voltage detected by the voltage detector 212 when the speed of the motor is a predetermined speed during the dehydration stroke. The preset speed may be about 150 rpm or less.

When the controller 220 detects the eccentricity, the controller 220 may check the detected voltage for a predetermined time, obtain an average value of the detected voltage for a predetermined time, and check the ripple value of the detected voltage for the predetermined time. Here, the predetermined time may be a preset time.

That is, when the controller 220 checks the detected voltage for a predetermined time, the controller 220 receives a voltage signal output from the voltage detector 212, recognizes a voltage value in the received voltage signal, and acquires an average value of the recognized voltage value for a predetermined time.

When the controller 220 acquires an average value of the detected voltages for a predetermined time, the controller 220 may obtain an average value of the voltages by using an integration over time.

When the controller 220 receives the voltage signal output through the voltage detector, the controller 220 checks the received voltage signal at a reference time interval, checks the predetermined number, checks the voltage values in the checked voltage signal, and checks the predetermined number of voltages. It is also possible to obtain the average voltage value of the values.

When the controller 220 checks the ripple value of the voltage, the controller 220 receives the voltage signal output from the voltage detector 212, recognizes the ripple signal from the received voltage signal, and checks the voltage value of the recognized ripple signal. Here, the voltage value of the ripple signal corresponds to the ripple value of the voltage.

When the controller 220 checks the ripple value of the voltage, it is also possible to check the highest ripple value having the largest value among the ripple values of the detected voltage for a predetermined time, and it is also possible to check the smallest lowest ripple value among the ripple values of the detected voltage for a certain time, and it is also possible to check the average ripple value of the ripple values of the detected voltage for a certain time.

The controller 220 acquires a diagonal eccentricity value corresponding to a ratio of the ripple value of the voltage and the average value of the voltage, and determines whether the diagonal eccentricity is based on the obtained eccentric value.

The controller 220 may obtain an eccentric value corresponding to a ratio of the ripple value of the voltage and the average value of the voltage, and determine that the obtained eccentric value is diagonally greater than or equal to a preset value.

When the controller 220 starts the dehydration stroke and performs the eccentric sensing operation, the controller 220 detects and determines the eccentricity by checking the current detected by the current detector 211 and the voltage detected by the voltage detector 212.

The controller 220 may detect the eccentricity by checking the current detected by the current detector 211 and the voltage detected by the voltage detector before performing the resonance operation.

The controller 220 may also detect and determine an eccentricity by checking the current detected by the current detector 211 and the voltage detected by the voltage detector when the speed of the motor is a predetermined speed during the dehydration stroke. The preset speed may be about 150 rpm or less.

When the controller 220 detects the eccentricity, the controller 220 can check the current and voltage detected for a predetermined time. At this time, the controller acquires power of the motor based on the checked current and voltage, and obtains an average value of the acquired power for a predetermined time, and checks the ripple value of the detected power. Here, the predetermined time may be a preset time.

That is, when the controller 220 checks the power of the motor for a predetermined time, the controller 220 receives the current signal output from the current detector 211 and the voltage signal output from the voltage detector 212, and obtains a power value based on the received current and voltage signals, and obtains an average value with respect to the power value obtained for a certain time.

The controller 220 may obtain a current value of the current signal and a voltage value of the voltage signal received for a predetermined time, and may obtain a power value for a predetermined time by calculating the obtained current value and the voltage value.

When the controller 220 acquires an average value of power for a predetermined time, the controller 220 may obtain an average value of power by using an integration over time.

When the controller 220 checks the ripple value of the power, the controller 220 obtains the ripple value of the power from the power value acquired for a predetermined time.

When the controller 220 checks the ripple value of the power, it is also possible to check the highest ripple value having the largest value among the ripple values of the power acquired for a certain time, and it is also possible to check the smallest lowest ripple value among the ripple values of the detected power for a certain time, and it is also possible to check the average ripple value of the ripple values of the detected power for a certain time.

The controller 220 obtains a diagonal eccentricity value corresponding to the ratio of the ripple value of the power and the average value of the power, and determines whether the diagonal eccentricity is occurred based on the obtained eccentric value.

The controller 220 obtains an eccentric value corresponding to the ratio of the ripple value of the current and the average value of the current. and if the obtained eccentric value is greater than or equal to a preset value, it may be determined as a diagonal eccentricity. The preset value may be a value smaller than the reference value.

The controller 220 may include a memory (not shown) that stores data about an algorithm or a program that reproduces the algorithm, and a processor that performs the above-described operation using data stored in the memory. In this case, the memory and the processor may be implemented as separate chips or the memory and the processor may be implemented in a single chip.

The storage 220*a* stores a laundry program that can be executed in the washing machine.

The storage 220*a* may store a preset speed and a reference value.

The storage 220*a* may store a predetermined time and a preset number, and may store a preset value.

The storage 220*a* may store the first speed, the second speed, the third speed, the fourth speed, and the fifth speed for the dehydration stroke.

The storage 220*a* may store the execution time of each stroke corresponding to the weight of the laundry and the speed information of the motor for each washing program.

The storage 220*a* may store information corresponding to the speed and the execution time of the motor for each operation of the dehydration stroke.

The storage 220*a* may store an algorithm for determining diagonal eccentricity.

storage 220*a* may be implemented by a Nonvolatile memory devices such as cache, read only memory (ROM), programmable ROM (PROM), erasable programmable ROM (EPROM), electrically erasable programmable ROM (EEPROM), and flash memory, or a volatile memory device such as random access memory (RAM) or a storage medium such as a hard disk drive (HDD) or a CD-ROM, but it is not limited to this. The storage 220*a* may be a memory implemented as a separate chip from the processor described above with respect to the controller 220, or may be implemented as a single chip with the processor.

The driver 230 drives the motor 180 based on the control command of the controller 220. The driver 230 may include an inverter 231. That is, the driver 230 may include an inverter 231 for generating a driving current of the motor 180 according to a control command of the controller 220 so that the motor 180 generates a driving force.

The driver 230 may turn on/off the plurality of switching elements Q11 to Q13 and Q21 to Q23 of the inverter 231 based on the control signal VPWM output from the controller 220. This driver 230 will be described with reference to FIG. 8.

Figure 8:
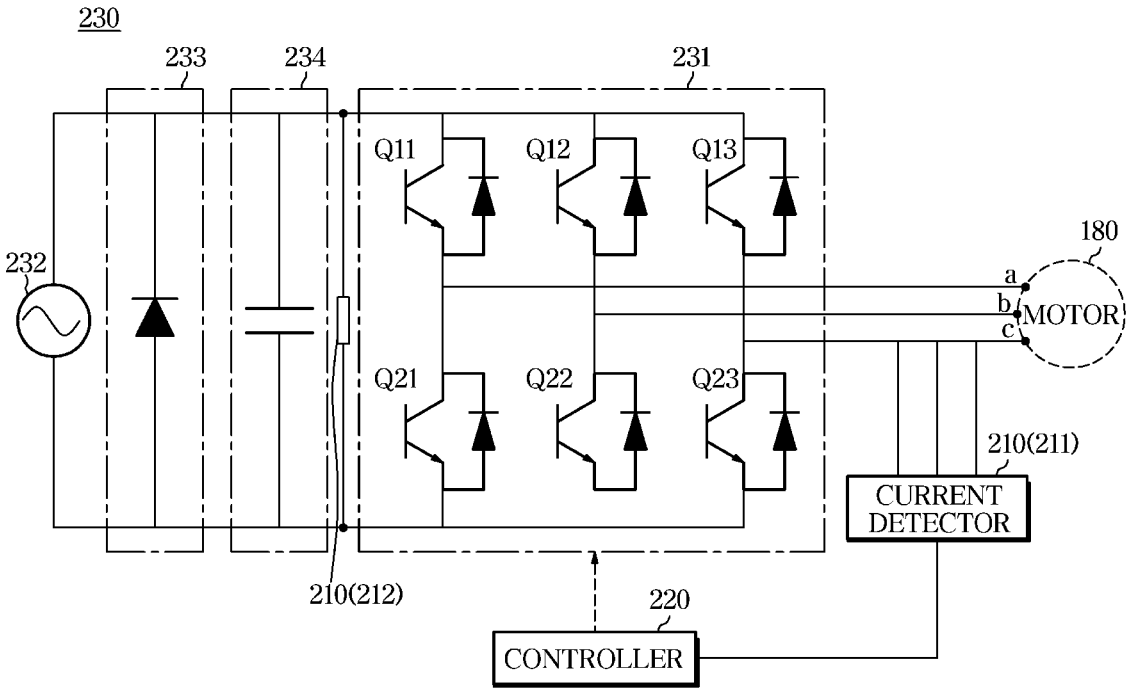
FIG. 8 is a detailed configuration diagram of the driver provided in the washing machine according to an embodiment.

As shown in FIG. 8, the driver 230 further includes a power supplier 232, a rectifier 233, and a smoother 234 in addition to the inverter 231.

The power supplier 232 is connected to an external power supply terminal (not shown) and receives a commercial AC power from the outside and delivers it to the rectifier 233.

First, the rectifier 233 includes at least one diode, rectifies AC power input from the power supplier 232, and transfers the rectified power to the smoother 234.

smoother 234 includes at least one capacitor, and smoothes the power transmitted from the rectifier 233 to lower the pulsation of the current of the power rectified by the rectifier 233, and converts it into a direct current (DC) power of a predetermined size for driving the motor 180 and transfers to the inverter 231.

The inverter 231 of the driver may apply a driving voltage corresponding to the voltage command to the motor 180, and supply a current corresponding to the current command to the motor 180.

The inverter 231 includes a plurality of switching elements for converting the DC power transmitted from the smoother 234 into three-phase AC power.

A plurality of switching elements of the inverter 231 are driven in accordance with the control command of the controller 220 to modulate the pulse width delivered to the motor 180.

Here, the plurality of switching elements of the inverter 231 may include three upper switching elements Q11 to Q13 and three lower switching elements Q21 to Q23.

Each of the three upper switching elements Q11 to Q13 and the three lower switching elements Q21 to Q23 may be connected in series. That is, the first upper switching circuit Q11 is connected in series with the first lower switching circuit Q21 on the U stage, and the second upper switching circuit Q12 is connected in series with the second lower switching circuit Q22 in the V stage, and the third upper switching circuit Q13 may be connected in series with the third lower switching circuit Q23 on the W stage. In addition, the diode may be connected in parallel with the U, V, and W stages.

In addition, three nodes to which the three upper switching circuits Q11 to Q13 and the three lower switching circuits Q21 to Q23 are connected respectively to three input terminals a, b, and c of the motor 180. Accordingly, current may be supplied to the motor 180 through three input terminals a, b, and c.

The voltage detector 212 of the washing machine may be connected to both ends of the smoother 234 that outputs a DC voltage. The voltage detector 212 may detect a DC voltage.

Figure 9:
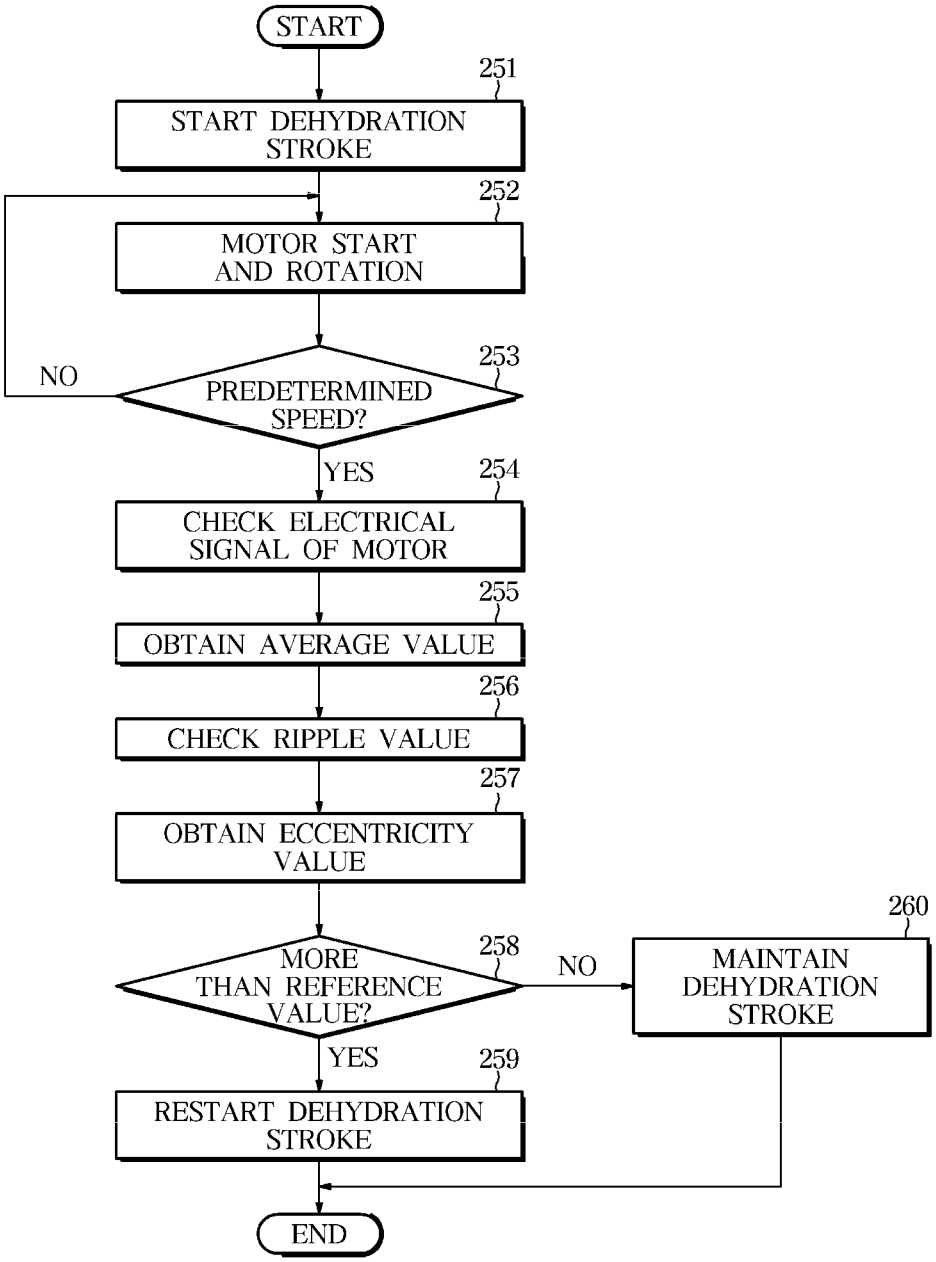
FIG. 9 is a control flowchart of a washing machine according to an embodiment of the present disclosure.

FIG. 9 is a control flowchart of a washing machine according to an embodiment of the present disclosure, which will be described with reference to FIGS. 10A and 10B.

The washing machine performs an operation based on at least one of a washing program and an option input to the input 191.

The washing machine controls the operation of the water supplier 150, the heater 140, the drain 170 and the operation of the motor 180 when the driving is performed, thereby performing the washing stroke, the rinsing stroke, the dehydration stroke, and the drying corresponding to at least one of the selected laundry program and options.

The washing machine displays performance information of the washing machine on the display 192 during driving.

The washing machine determines whether a stroke to be performed currently is a dehydration stroke based on at least one of the selected laundry program and options, and if it is determined that the stroke to be performed currently is a dehydration stroke, the washing machine starts dehydration stroke (251).

When the washing machine starts the dehydration stroke, the washing machine senses the weight of the laundry contained in the rotating tub.

When the washing machine senses the weight of the laundry, the motor 180 is rotated at a first speed for a predetermined time, and then the rotation of the motor 180 is stopped, and the weight of the laundry is detected based on the acceleration generated at this time.

Here, the first speed may be a speed at which the laundry is uniformly distributed in the rotating tub.

The washing machine determines the execution time of the dehydration stroke based on the detected laundry weight.

Here, determining the execution time of the dehydration stroke may include determining the execution time of the high speed rotation operation (SH, see FIG. 6).

Determining an execution time of the dehydration stroke may further include determining an execution time of at least one of an eccentric sensing operation SUB, a resonance operation SR, a pre-spin operation SPS, and a rebalancing operation SRB.

It is also possible to determine the dehydration intensity of the dehydration stroke based on the detected laundry weight. Here, the dehydration intensity may be an intensity corresponding to the maximum speed of the motor.

The washing machine may omit the weight sensing operation of the laundry during the dehydration stroke by checking the washing stroke or the weight of the laundry detected at the rinsing stroke.

The washing machine is possible to omit the weight detection operation of the laundry during the washing stroke or rinsing stroke by checking the detected laundry weight.

The washing machine controls the starting of the motor when the laundry weight sensing operation is completed. When the starting of the motor 180 is completed, the motor is rotated (252) but the rotation speed of the motor is increased. At this time, the washing machine increases the speed of the motor to a preset speed.

The washing machine controls the starting of the motor when the weight detection operation of the laundry is completed, and rotates the motor (252) when the starting of the motor 180 is completed, but increases the rotation speed of the motor. At this time, the washing machine increases the speed of the motor to a preset speed.

Herein, the preset speed may be a speed of 150 rpm or a second speed faster than the first speed, or may be slower than 150 rpm.

Also, the preset speed may be the speed of the motor before performing the resonance operation. Here, the resonance operation is an operation section in which vibration starts to occur in the rotating tank by motor acceleration. Therefore, the washing machine can detect an eccentricity before vibration caused by motor acceleration occurs.

The washing machine determines whether the speed of the motor 180 is a preset speed (253), the speed of the motor is maintained at a preset speed when it is determined that the speed of the motor 180 is a preset speed, and checks the operation information of the motor for a certain time while the motor speed is maintained at the preset speed.

Checking the operation information of the motor here includes checking 254 an electrical signal applied to the motor (254).

The electrical signal applied to the motor may include a current signal.

The electrical signal applied to the motor may be a voltage signal or a power signal.

The washing machine acquires an average value of the electrical signals for a predetermined time (255) and checks the ripple value for the predetermined time (256).

When the washing machine checks the ripple value for a predetermined time, the washing machine checks the largest maximum ripple value among the ripple values of the ripple signal generated during the predetermined time.

In addition, when the washing machine checks the ripple value for a predetermined time, it is also possible to check the smallest minimum ripple value among the ripple values of the ripple signal generated during the predetermined time.

In addition, when the washing machine checks the ripple value for a predetermined time, it is also possible to check the average ripple value of the ripple values of the ripple signal generated during the predetermined time.

The configuration for obtaining the average value of the electrical signal and checking the ripple value will be described in more detail.

As an example, a configuration of obtaining an average value of an electrical signal and checking a ripple value using a current signal applied to a motor will be described.

The washing machine checks the current signal detected for a predetermined time by the current detector, recognizes the current value in the identified current signal, and obtains an average value of the recognized current value for a predetermined time.

When the washing machine acquires the average value of the currents detected for a certain time, the washing machine may obtain the average value of the currents by using the integration over time.

The washing machine recognizes the ripple signal from the identified current signal and checks the current value of the recognized ripple signal. Here, the current value of the ripple signal corresponds to the ripple value of the current.

When the washing machine checks the ripple value of the current, the washing machine checks the highest ripple value having the largest value among the ripple values of the current detected for a certain time.

In addition, the washing machine may check the smallest minimum ripple value among the ripple values of the current detected for a certain time, and may determine the average ripple value of the ripple values of the current detected for a certain time.

As another example, a configuration of obtaining an average value of an electrical signal and checking a ripple value using a voltage signal applied to a motor will be described.

The washing machine checks the voltage signal detected for a predetermined time by the voltage detector, recognizes the voltage value from the identified voltage signal, obtains the average value of the voltages of the recognized voltage values, and checks the ripple value of the checked voltage for the predetermined time.

When the washing machine acquires an average value of the recognized voltage values for a certain time, the washing machine may obtain the average value of the voltage by using the integral over time.

When the washing machine checks the ripple value of the voltage, the washing machine recognizes the ripple signal from the checked voltage signal and checks the voltage value of the recognized ripple signal. Here, the voltage value of the ripple signal corresponds to the ripple value of the voltage.

The washing machine checks the highest ripple value having the largest value among the ripple values of the checked voltage for a certain time.

In addition, the washing machine may check the smallest minimum ripple value among the ripple values of the voltage checked for a certain time, and may also check the average ripple value of the ripple values of the checked voltage for a certain time.

As another example, a configuration of obtaining an average value of an electrical signal and checking a ripple value by using a power signal applied to a motor will be described.

The washing machine checks the current signal detected for a predetermined time by the current detector and the voltage signal detected for a predetermined time by the voltage detector.

The washing machine recognizes the current value in the identified current signal, recognizes the voltage value in the voltage signal, and obtains a power value corresponding to the power signal of the motor for a predetermined time.

The washing machine recognizes the current value in the identified current signal, recognizes the voltage value in the voltage signal, and obtains a power value corresponding to the power signal of the motor for a predetermined time.

The washing machine obtains an average value of power values for a certain time.

When the washing machine acquires an average value of the recognized power values for a certain time, the washing machine may obtain the average value of the power by using the integral over time.

The washing machine acquires a power signal for a predetermined time by a current signal and a voltage signal for a predetermined time, recognizes a ripple signal in the obtained power signal for a predetermined time, and checks a power value corresponding to the recognized ripple signal. Herein, the power value corresponding to the ripple signal corresponds to the ripple value of power.

When the washing machine checks the ripple value of the power, the washing machine checks the highest ripple value having the largest value among the ripple values of the power for a certain time.

In addition, the washing machine may check the smallest minimum ripple value among the ripple values of the power for a certain time, and may determine the average ripple value of the ripple values of the power for a certain time.

The washing machine obtains an eccentric value by dividing the average value of the obtained electrical signal by the identified ripple value (257).

The washing machine selects the highest ripple value among the ripple values of the electrical signal for a certain period of time, and obtains the eccentric value by dividing the average value of the electrical signal by the selected highest ripple value.

In addition, the washing machine may obtain an eccentric value using a minimum ripple value or an average ripple value among the ripple values of the electrical signal.

Here, the eccentric value includes an eccentric value detected by the occurrence of the diagonal eccentricity.

Figure 10A:
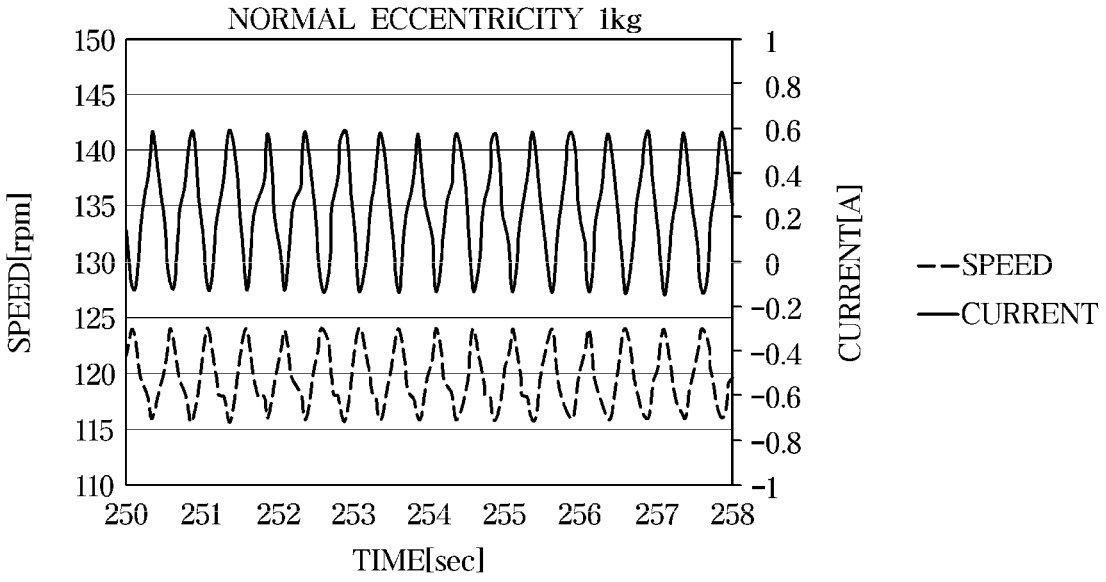
FIGS. 10A and 10B are graphs illustrating a speed and a current of a motor when a general eccentricity and a diagonal eccentricity occur in a washing machine according to an embodiment.
Figure 10B:
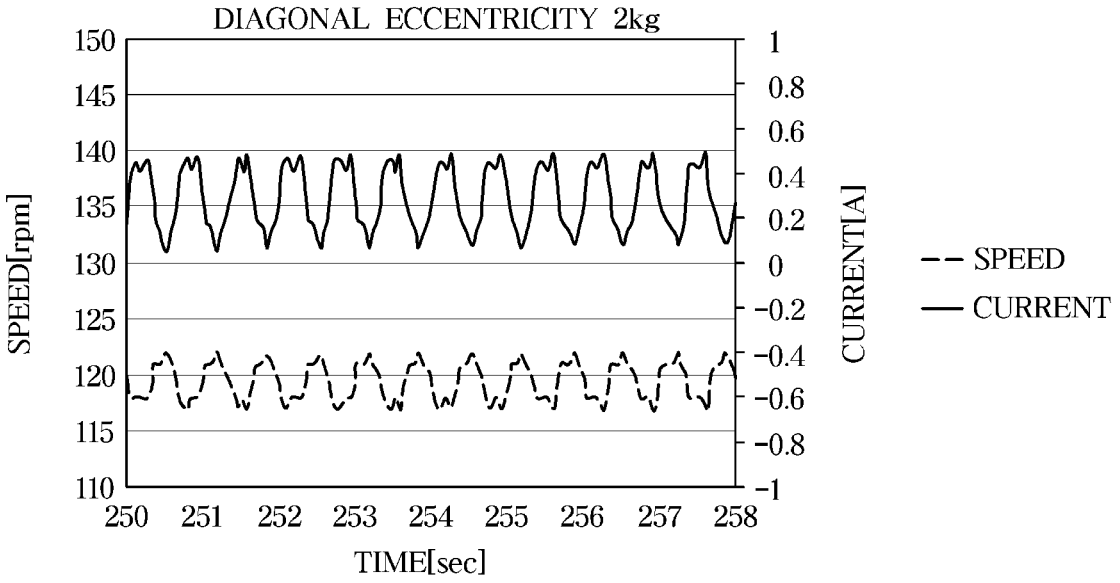

FIG. 10A is a graph of the speed and current of the motor when a general eccentricity occurs, and FIG. 10B is a graph of the speed and the current of the motor when a diagonal eccentricity occurs.

As shown in FIGS. 10A and 10B, when the general eccentricity occurs in the washing machine, the average value of the current of the motor is small and the ripple value is large. When a diagonal eccentricity occurs in the washing machine, the average value of the current is large and the ripple value is small.

The following table shows the ripple, average and eccentricity values of the currents when the normal and diagonal eccentricity are obtained by experiment.

| | Normal eccentricity | Diagonal eccentricity |
|---|---|---|
| Ripple value for current | 0.733 A | 0.385 A |
| Average value for current | 0.227 A | 0.297 A |
| Eccentricity value | 0.310 A | 0.771 A |

When the eccentric value is obtained by dividing the average value of the electrical signal by the identified ripple value, it can be seen that the eccentric value is larger than the eccentric value when the general eccentricity occurs when the diagonal eccentricity occurs.

As can be seen from the graphs and tables, when the eccentricity is detected by the ripple value of the motor current, it is difficult to detect and determine the diagonal eccentricity because the current ripple value is smaller than the ripple value of the current when the diagonal eccentricity is general eccentricity.

As can be seen from the graphs and tables, when the eccentricity is detected by the ripple value of the motor current, it is difficult to detect and determine the diagonal eccentricity because the current ripple value is smaller than the ripple value of the current when the diagonal eccentricity is general eccentricity.

However, when the eccentric value is obtained by using the average value of the current and the ripple value, the difference between the average value of the current and the ripple value becomes smaller when the diagonal eccentricity occurs, so when the average value of the current is divided by the ripple value, the large eccentric value is obtained.

Therefore, since the eccentricity value when the diagonal eccentricity is generated is larger than the eccentricity value when the general eccentricity occurs, it is very easy to detect and judge the diagonal eccentricity.

In this way, the washing machine may detect the occurrence of the eccentricity based on the eccentric value obtained by the average value of the current and the ripple value of the current.

During the dehydration stroke, the friction on the shaft of the motor increases and the load torque increases, so when eccentricity occurs, the period in which vibration occurs and the period in which ripple occurs in correspondence with the rotation period of the motor.

That is, when eccentricity occurs during the dehydration stroke, the voltage signal and the power signal of the motor having the same characteristics as that of the current signal flowing through the motor can be detected.

That is, when eccentricity occurs during the dehydration stroke, the voltage signal and the power signal of the motor having the same characteristics as that of the current signal flowing through the motor can be detected.

In other words, when a diagonal eccentricity occurs in the washing machine, ripple occurs in the voltage signal and ripple occurs in the power signal similarly to the ripple of the current signal.

Therefore, it is possible to obtain an eccentric value for determining the diagonal eccentricity through the average value and the ripple value of the voltage signal, and to obtain an eccentric value for determining the diagonal eccentricity through the average value and the ripple value of the power signal.

The washing machine compares the obtained eccentricity value with the reference value (258), and if it is determined that the acquired eccentricity value is greater than or equal to the reference value, it determines that a diagonal eccentricity has occurred.

That is, in the washing machine, it can be determined that the laundry w1 is positioned on the rear side of the rotating tub 130, that is, on the first side of the surface facing the inlet 130*a*, and be determined that the laundry w2 is positioned on the second side of the front of the rotating tub 130, that is, on the side adjacent to the inlet 130*a*. Here, the first side and the second side may be diagonal to each other.

Next, the washing machine stops the dehydration stroke based on the determination of the diagonal eccentricity, and then performs the dehydration stroke again from the beginning (259).

Through this, if it is determined that the diagonal eccentricity is severely generated during the eccentric sensing operation, the resonance operation may be prevented by stopping the dehydration stroke. Therefore, the vibration can be prevented from being severely generated in the washing machine, thereby preventing damage to the washing machine.

Re-executing g the dehydration stroke from the beginning can be performed from the weight sensing operation.

Re-executing g the dehydration stroke from the beginning can be performed from the eccentric detection operation.

Re-executing the dehydration stroke from the beginning may include re-executing the dehydration stroke after the set time has elapsed after the dehydration stroke is stopped.

The washing machine maintains the dehydration stroke when it is determined that the obtained eccentric value is less than the reference value (260).

Maintaining the dehydration stroke may include completing the eccentric sensing operation and sequentially performing the resonance operation SR, the free spin operation SPS, the rebalancing operation SRB, and the high speed rotation operation SH (see FIG. 6).

Maintaining the dehydration stroke may include completing the eccentric sensing operation and performing a high speed rotation operation. In this case, the washing machine may increase the speed of the motor from the preset speed to the fifth speed for the dehydration operation.

Figure 11:
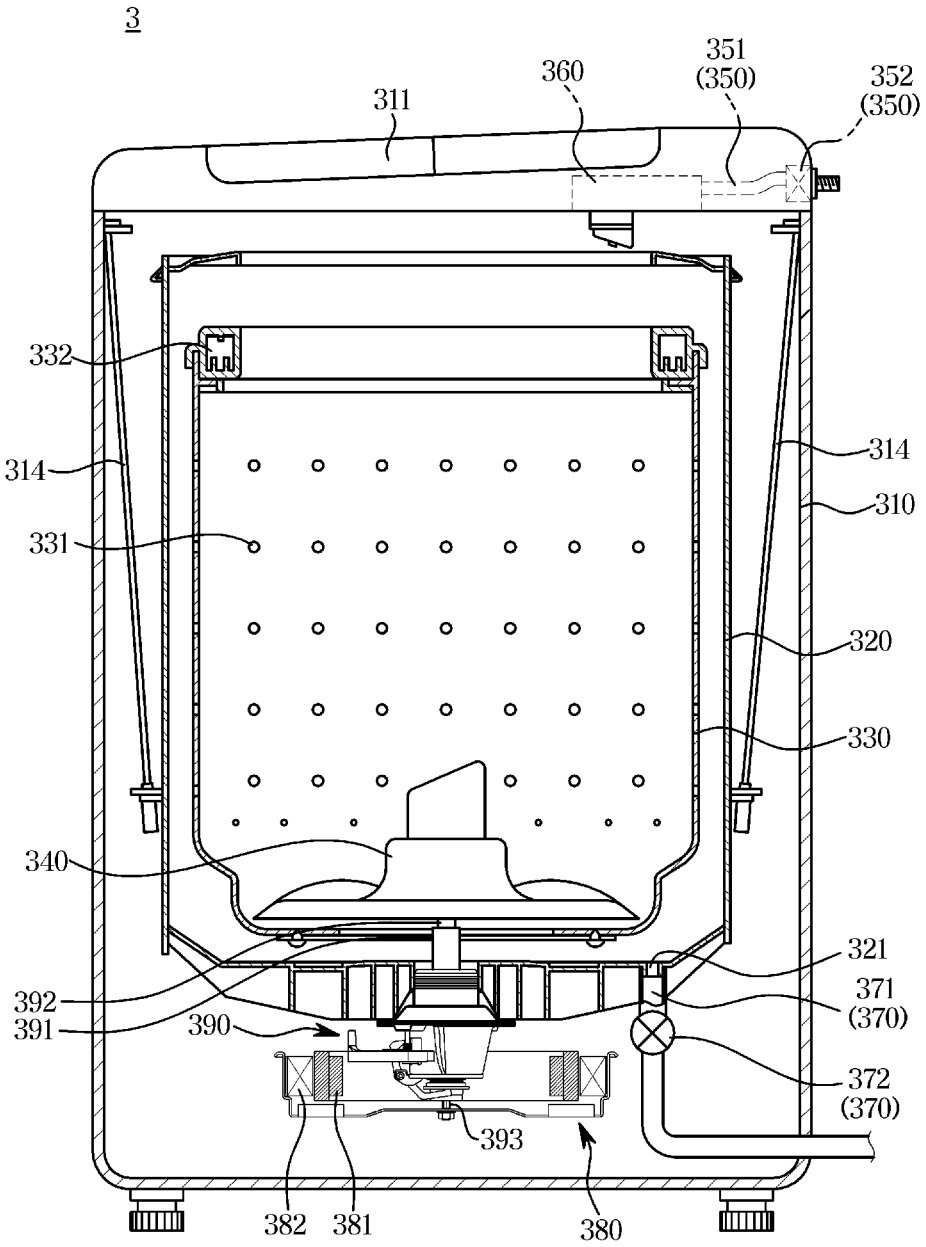
FIG. 11 is a cross-sectional view of a washing machine according to another embodiment.

That is, the washing machine may control the speed of the motor to be increased from the second speed to the fifth speed so that the present dehydration operation is performed, FIG. 11 is a cross-sectional view of a washing machine according to another embodiment.

The washing machine according to another embodiment may be a top loading washing machine in which a rotating tub is vertically disposed and a laundry inlet formed thereon.

As shown in FIG. 11, the washing machine 3 includes a cabinet 310 forming an exterior, a water tank 320 disposed inside the cabinet 310 and storing wash water, and a pulsator 340 rotatably disposed in the interior of the rotating tub 330 and generating water flow by rotation.

An inlet is provided in the upper part of the cabinet 310, and the movable door 311 is provided. Here, the inlet is a place where laundry is input and discharged, and may be opened and closed by the door 311.

The water tank 320 is supported in a locked state by the damper 314 connecting the lower side of the outer surface of the water tank 320 and the inner upper portion of the cabinet 110. The damper 314 suppresses the vibration generated in the water tank 120 during washing or dehydration to the cabinet 310.

In the present embodiment, two dampers 314 may be provided. In addition, the number of dampers is not limited.

At the top of the water tank 320 is a water supplier 350 that receives external water and delivers the supplied water to the water tank 320.

The water supplier 350 includes a water supply pipe 351 connected to an external water supply source (not shown), and a water supply valve #52 provided at the water supply pipe 351 to allow or block the supply of water.

The washing machine 3 further includes a detergent supplier 360 storing the detergent and supplying the stored detergent to the water tank 320 and the rotating tub 330.

That is, the water supplied through the water supply pipe 351 of the water supplier may move into the water tank 320 and the rotating tub 330 together with the detergent via the detergent supplier 360.

The rotating tub 330 is provided in a cylindrical shape with an open top, and includes a plurality of holes 331 provided on an outer circumferential surface thereof. Here, the plurality of holes 331 allow the internal space of the rotating tub 330 and the internal space of the water tank 320 to communicate with each other so that water can move between the internal space of the rotating tub 330 and the internal space of the water tank 320.

An upper portion of the rotating tub 330 may be equipped with a balancer 332 for offsetting the unbalanced load generated in the rotating tub 330 when the rotating tub 330 rotates so that the rotating tub 330 rotates stably.

The rotating tub 330 is connected to the motor 380 by the dehydration shaft 391. In this case, the rotational force generated by the motor 380 may be transmitted to the dehydration shaft 391. Accordingly, when the dehydration shaft 391 rotates, the rotating tub 320 may rotate counterclockwise or clockwise with the dehydration shaft 392.

The pulsator 340 performs forward rotation or reverse rotation and generates water flow. At this time, the laundry in the rotating tub 330 may be stirred together with the wash water by the water flow of the pulsator 340.

When performing the washing stroke or the rinsing stroke, the rotating tub 330 connected to the dehydration shaft 391 may rotate only the pulsator 340 without rotating.

The pulsator 340 may be connected to the motor 380 by the washing shaft 392. At this time, the rotational force generated by the motor 380 may be transmitted to the washing shaft 392. Accordingly, when the washing shaft 392 rotates, the pulsator 340 may rotate counterclockwise or clockwise with the washing shaft 392.

The bottom of the water tank 320 is provided with a drain 321 for discharging the wash water stored in the water tank 320 to the outside.

The washing machine 3 may further include a drain 370 for discharging water of the water tank 320 to the outside. That is, the drain 370 may include a drain pipe 371 connected to the drain 321 of the water tank 320 and a drain valve 372 for controlling the drainage of the drain pipe 371.

The washing machine 3 further includes a motor 380 and a clutch 390 to rotate at least one of the rotating tub 330 and the pulsator 340 to allow the washing machine to perform various strokes. The motor 380 and the clutch 390 of the present embodiment may have a direct type structure arranged in a vertical line.

The motor 380 is provided at a lower end of the water tank 320, and generates driving force when power is applied, and applies the generated driving force to at least one of the rotating tub 330 and the pulsator 340.

This motor 380 includes a circular stator (i.e. stator 381) and a rotor (i.e. rotor 382) disposed on the outer periphery of the stator 381.

The stator 381 may include an annular base, a plurality of teeth disposed along an outer circumference of the base and protruding outward with respect to the radial direction of the stator, and a coil wound around each of the plurality of teeth. The coil may generate a magnetic field by the current flowing through the coil, and the plurality of teeth may be magnetized by the generated magnetic field.

When the stator is engaged with the clutch 390, the clutch 190 may be seated on the mounting surface of the stator.

The rotor 382 includes a plurality of permanent magnets disposed on the inner surface of the side wall, which permanently interact with the coil of the stator. This rotates the rotor.

As the shaft of the clutch 390 is coupled to the rotor 382, the drive shaft 393 and the rotor 382 of the clutch 390 may be coupled to each other. The shaft of the clutch 390 coupled to the rotor 382 is connected to the washing shaft 392 through the hollow of the dehydration shaft 391, the washing shaft 392 is coupled to the pulsator 340 again through the hollow of the dehydration shaft.

The clutch 390 is disposed between the motor 380 and the water tank 320 and receives the driving force from the motor 380 to selectively transmit the driving force of the motor 380 to the rotating tub 330 and the pulsator 340.

The clutch driving shaft 393 allows power generated by the motor 380 to be transmitted to the washing shaft 392 and the dehydration shaft 391. The clutch driving shaft 393 is a rod-shaped shaft, and always rotates integrally with the motor 380.

The clutch 390 operates in the first operation mode when performing the washing stroke and the rinsing stroke, and operates in the second operation mode when performing the dehydration stroke.

When the clutch 390 operates in the second operation mode as described above, the motor 380 is rotated in only one direction by the bearing of the clutch.

In other words, when the clutch 390 operates in the second operation mode, the washing shaft 392 and the dehydration shaft 391 rotate as one rigid body. That is, in the second operation mode, the rotation speed of the motor 380, the rotation speed of the pulsator 340, and the rotation speed of the rotating tub 330 are all the same, and the rotation direction is also the same.

Figure 12:
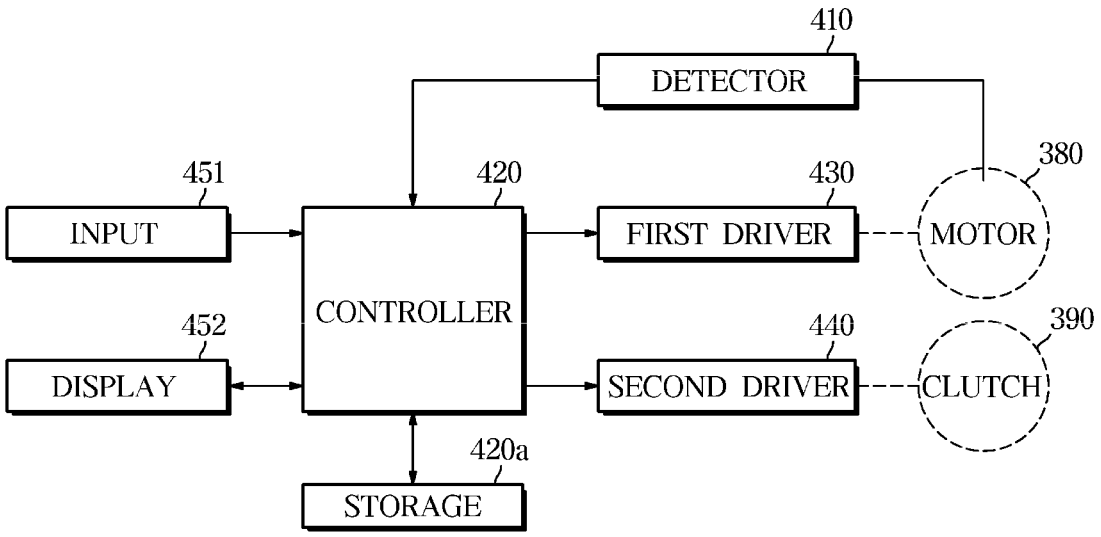
FIG. 12 is a control block diagram of a washing machine according to another embodiment.
Figure 13:
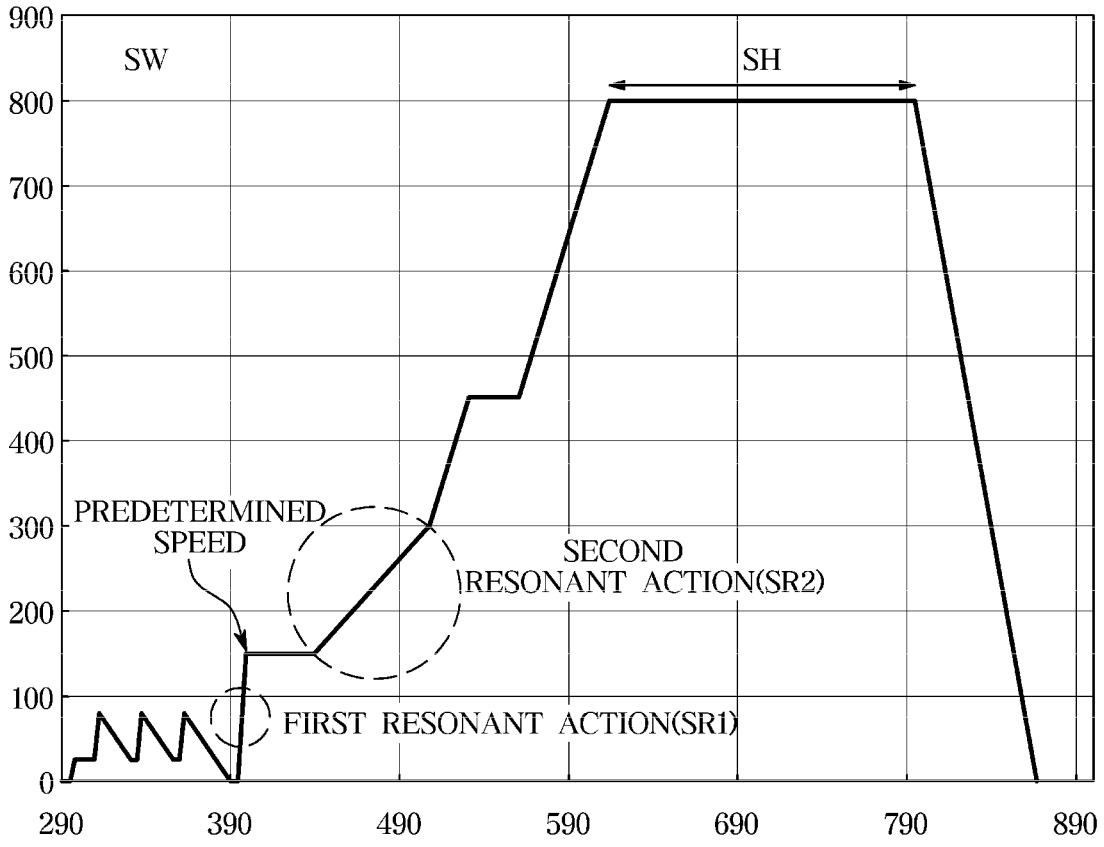
FIG. 13 is a detailed operation example of the dehydration stroke of the washing machine according to another embodiment.

FIG. 12 is a control configuration diagram of a washing machine according to another embodiment, which will be described with reference to FIG. 13, FIG. 13 is a detailed operation example of the dehydration stroke of the washing machine according to another embodiment.

As shown in FIG. 12, the washing machine 3 includes an input 451, a display 452, a detector 410, a controller 420, a first driver 430, and a second driver 440.

The input 451 receives an operation command from the user.

The input 451 may include a plurality of buttons for receiving a start, pause, and stop command, and may further include a button for receiving a laundry program.

In addition, the input 451 may further include a button for receiving an option.

The options may include at least one of the amount of water, the temperature of the water, the time of the washing stroke, the number of rinsing strokes, the intensity of the dehydration stroke and the time of the dehydration stroke.

The display 452 displays information related to the state or operation of the washing machine 1, displays information input to the input unit, and displays information for guiding a user's input.

The detector 410 detects an electrical signal applied to the motor 380 to recognize operation information of the motor 180 and outputs the detected electrical signal.

The operation information of the motor may include at least one of a current applied to the motor 380, a voltage applied to the motor 380, and power of the motor 380. That is, the electrical signal may include at least one of a current signal, a voltage signal, and a power signal.

The detector 410 may include a current detector for detecting a current applied to the motor 380. The current detector may detect a current applied to the motor 380 through at least one input terminal among three phase input terminals of the motor provided in the first driver 430, and may output a signal corresponding to the detected current. The signal may be a signal corresponding to the value of the current applied to the motor 380.

The detector 410 may include a voltage detector for detecting a voltage applied to both ends of the motor 380. The voltage detector may detect DC voltages at both ends of the DC voltage provided in the first driver 430.

The detector 410 is for detecting power of the motor 380, and may include a current detector for detecting a current applied to the motor 380, and a voltage detector for detecting a voltage applied to both ends of the motor 380.

The controller 420 controls the overall operation of the washing machine 3.

The controller 420 controls the operation of the washing machine based on the weight of the laundry, the washing program and the options input to the INPUT 210.

The controller 420 controls the operation of the water supplier 350, and the drain 370 when controlling the operation of the washing machine, and controls the operation of the motor 380 and the clutch 390 to select the washing stroke, the rinsing stroke, a dehydration stroke and the drying stroke corresponding to the selected washing program and at least one option.

More specifically, the controller 420 checks the weight of the laundry corresponding to sensing information detected by a weight detector (not shown) when the washing program is executed, and adjusts the water supply amount based on the checked laundry weight and the washing program selected by the user to control the washing stroke and the rinsing stroke, and controls the dehydration stroke based on the weight of the identified laundry and the washing program.

The controller 420 controls the operations of the water supplier 350, the motor 380, the clutch 390, and the drain 470 during the washing stroke and the rinsing stroke control, and controls the motor 380, the clutch 390 and the drain 470 during the dehydration stroke control.

The controller 420 may control the clutch 390 in the first operation mode during the washing stroke and the rinsing stroke control, and control the clutch 390 in the second operation mode during the dehydration stroke control.

The controller 420 may receive a current supplied to the motor 380 detected by the detector 410, and may control the speed of the motor 380 based on a result of comparison between the detected current and the target current.

As shown in FIG. 13, The controller 420 performs a weight sensing operation (SW) for sensing the weight of the laundry, first and second resonant operations SR1 and SR2 in which vibrations are generated by the rotation of the rotating tub, and the high speed rotation operation (SH) during the dehydration stroke, such as the middle and final dehydration stroke.

The controller 420 repeats the process of stopping the rotation of the motor 380 after rotating the motor 380 to the first speed in order to perform the weight sensing operation (SW) during the dehydration stroke, and performs a weight sensing operation of the laundry based on the generated counter electromotive force. Here, the first speed may be a speed of approximately 90 rpm.

The controller 420 controls the rotation of the motor 380 after the weight sensing operation is completed during the dehydration stroke, and controls the operation of the motor 380 such that the rotation speed of the motor 380 is increased to the second speed. Here, the second speed may be about 150 rpm or less.

The controller 420 may perform the first resonant operation SR1 when controlling the rotation speed of the motor 380 to increase to the second speed. Here, the speed of the motor in the first resonant operation may be a speed between approximately 50 rpm and 90 rpm.

The controller 420 controls the operation of the motor such that the motor rotates for a predetermined time at a preset speed before performing the second resonant operation SR2.

The controller 420 may maintain the operation of the motor for a predetermined time when the first resonant operation SR1 is completed.

In addition, the controller 420 may control the operation of the motor such that the speed of the motor is maintained at the preset speed for a predetermined time when the speed of the motor is preset.

The controller 420 checks the operation information of the motor for a predetermined time while the motor speed is maintained at the preset speed, detects the eccentricity and determines the occurrence of the eccentricity based on the confirmed operation information of the motor. Checking the operation information of the motor here includes checking the electrical signal applied to the motor in operation.

That is, the controller 420 acquires an eccentric value based on an electrical signal applied to the motor 380 for a predetermined time, detects the occurrence of the eccentricity based on the obtained eccentric value, and determines whether the diagonal eccentricity is generated based on the detection result.

The controller 420 obtains an eccentric value based on an electrical signal applied to the motor 380 between the first resonant operation SR1 and the second resonant operation SR2, and detects an eccentric occurrence based on the obtained eccentric value, and is also possible to judge whether diagonal eccentricity has occurred based on the result.

The controller 420 may be located at the lower side of the rotating tub 130, the laundry is located above the rotating tub 130, the diagonal eccentricity can be determined based on the eccentricity generated when the lower laundry and the upper laundry is in a diagonal direction.

That is, in the case of the top loading washing machine, two dampers are disposed, and thus, two vibrations may be performed since the vibration may be generated more than the front loading washing machine.

The controller 420 of the top-loading washing machine senses an eccentricity before a lot of vibration is generated, that is, before performing the second resonance process.

The controller 420 controls the operation of the motor so that the motor rotates at the third speed to perform the second resonant operation SR2 after a predetermined time elapses, and when the speed of the motor reaches the third speed, the operation of the motor is controlled to perform the present dehydration operation.

The third speed may be a speed between 150 rpm and 300 rpm.

When the second resonant operation is completed, the controller 420 accelerates the speed of the motor to the fourth speed, and when the speed of the motor reaches the fourth speed, the speed of the motor is maintained at the fourth speed for the first execution time of the dehydration operation, and when the first execution time of the dehydration operation elapses, the speed of the motor is accelerated to the fifth speed, and when the speed of the motor reaches the fifth speed, the speed of the motor is maintained at the fifth speed for the second performance time of the present dehydration operation, and when the second performance time of the dehydration operation elapses, the operation of the motor is controlled to stop the rotation of the motor.

Here, the fourth speed may be about 450 rpm and the fifth speed may be about 800 rpm.

In addition, the controller 420 accelerates the speed of the motor to the fifth speed when the second resonant operation is completed, and when the speed of the motor reaches the fifth speed, the speed of the motor is maintained at the fifth speed for the execution time of the dehydration operation, and it is also possible to control the operation of the motor so that the rotation of the motor stops when the execution time of the dehydration operation elapses.

More specifically, the controller 420 may detect and determine the eccentricity by checking the current detected by the detector 410 when the speed of the motor is a preset speed during the dehydration stroke. The preset speed may be a speed between the speed of the motor in the first resonant operation and the speed of the motor in the second resonant operation.

The preset speed may be approximately 150 rpm.

In addition, the preset speed may be less than approximately 150 rpm.

When the controller 420 detects the eccentricity, the controller 420 may check current detected for a predetermined time, obtain an average value of the current detected for a predetermined time, and check the ripple value of the detected current for a predetermined time. Here, the predetermined time may be a preset time.

That is, when the controller 420 checks the current detected for a predetermined time, the controller 420 may receive a current signal output from the detector 410, recognize a current value in the received current signal, and obtain an average value of the recognized current value for a predetermined time. When the controller 420 acquires an average value of the detected currents for a predetermined time, the controller 420 may obtain an average value of the currents by using an integration over time.

When the controller 420 checks the ripple value of the current, the controller 420 receives the current signal output from the detector 410, recognizes the ripple signal in the received current signal, and checks the current value of the recognized ripple signal. Here, the current value of the ripple signal corresponds to the ripple value of the current.

When the controller 420 checks the ripple value of the current, the controller 420 may check the highest ripple value having the largest value among the ripple values of the current detected for a certain time, and may check the smallest lowest ripple value among the ripple values of the current detected for a certain time, and may check the average ripple value of the ripple values of the current detected for a certain time.

The controller 420 obtains a diagonal eccentricity value corresponding to a ratio of the ripple value of the current and the average value of the current, and determines whether the diagonal eccentricity is based on the obtained eccentric value.

The controller 420 checks the voltage detected by the detector 410 when the speed of the motor is a preset speed during the dehydration stroke.

The controller 420 checks the voltage detected by the detector 410 when the speed of the motor is a preset speed during the dehydration stroke.

The controller 420 may detect and determine the eccentricity by checking the voltage detected by the detector 410 before performing the second resonant operation.

When the controller 420 detects the eccentricity, the controller 420 may check the detected voltage for a predetermined time, obtain an average value of the detected voltage for a predetermined time, and check the ripple value of the detected voltage for the predetermined time. Here, the predetermined time may be a preset time.

That is, when the controller 420 checks the detected voltage for a predetermined time, the controller 420 may receive a voltage signal output from the detector 410, recognize a voltage value in the received voltage signal, and obtain an average value of the recognized voltage value for a predetermined time.

When the controller 420 acquires an average value of the detected voltages for a predetermined time, the controller 420 may obtain an average value of the voltages by using an integration over time.

When checking the ripple value of the voltage, the controller 420 receives the voltage signal output from the detector 410, recognizes the ripple signal from the received voltage signal, and checks the voltage value of the recognized ripple signal. Here, the voltage value of the ripple signal corresponds to the ripple value of the voltage.

When the controller 420 checks the ripple value of the voltage, the controller 420 may check the highest ripple value having the largest value among the ripple values of the detected voltage for a certain time, and may check the smallest lowest ripple among the ripple values of the detected voltage for a certain time, and may check the average ripple value of the ripple values of the detected voltage for a certain time.

The controller 420 obtains a diagonal eccentricity value corresponding to a ratio of the ripple value of the voltage and the average value of the voltage, and determines whether it is the diagonal eccentricity based on the obtained eccentric value.

The controller 420 may detect and determine the eccentricity by checking the current and voltage detected by the detector 410 when the speed of the motor is a preset speed during the dehydration stroke. The preset speed may be about 150 rpm or less.

When the controller 420 detects the eccentricity, the controller 420 can check the current and voltage detected for a predetermined time. The controller 420 acquires the power of the motor based on the identified current and the voltage, and obtains the average value of the power acquired for the predetermined time, and checks the ripple value of the detected power for a predetermined time.

That is, when the controller 420 checks the power of the motor for a predetermined time, the controller 420 receives a current signal and a voltage signal, obtains a power value based on the received current signal and the voltage signal, and obtains an average value of the power values obtained for the predetermined time.

The controller 420 may obtain a current value of a current signal and a voltage value of a voltage signal received for a predetermined time, and may obtain a power value for a predetermined time by calculating the obtained current value and the voltage value.

When the controller 420 acquires an average value of power for a predetermined time, the controller 420 may obtain an average value of power by using an integration over time.

When the controller 420 checks the ripple value of the power, the controller 420 checks the ripple signal in the power signal acquired for a predetermined time and obtains the ripple value of the power corresponding to the checked ripple signal.

When the controller 420 checks the ripple value of the power, the controller 420 may check the highest ripple value having the largest value among the ripple values of the power acquired for a certain time, and may check the smallest lowest ripple among the ripple values of the detected power for a certain time, and may check the average ripple value of the ripple values of the detected power for a certain time.

The controller 420 acquires a diagonal eccentricity value corresponding to the ratio of the ripple value of the power and the average value of the power, and determines whether the diagonal eccentricity is based on the obtained eccentric value.

If the obtained eccentricity value is greater than or equal to the reference value, the controller 420 stops the dehydration stroke and performs the dehydration stroke again.

When the dehydration stroke is stopped, the controller 420 may stop and control the operation of the motor 380 to stop the rotation of the rotating tub.

The controller 420 maintains the dehydration stroke when the obtained eccentricity value is less than the reference value.

If the obtained eccentricity value is less than the reference value, the controller 420 may control to increase the speed of the motor to the fifth speed so that the present dehydration operation is performed.

The controller 420 may be implemented by a memory (not shown) that stores data about an algorithm or a program that reproduces the algorithm for controlling the operation of the components of the washing machine 3, and a processor that performs the above-described operation using the data stored in the memory. In this case, the memory and the processor may be implemented as separate chips, or the memory and the processor may be implemented in a single chip.

The storage 420*a* stores a laundry program that can be executed in the washing machine.

The storage 420*a* may store a preset speed and a reference value.

The storage 420*a* may store a predetermined time and a preset number, and may store a preset value.

The storage 420*a* may store the first speed, the second speed, the third speed, the fourth speed, and the fifth speed for the dehydration stroke.

The storage 420*a* may store the execution time of each stroke corresponding to the weight of the laundry and the speed information of the motor for each washing program.

The storage 420*a* may store information corresponding to the speed and the execution time of the motor for each operation of the dehydration stroke.

The storage 420*a* may store an algorithm for determining diagonal eccentricity.

storage 420*a* may be implemented by a Nonvolatile memory devices such as cache, read only memory (ROM), programmable ROM (PROM), erasable programmable ROM (EPROM), electrically erasable programmable ROM (EEPROM), and flash memory, or a volatile memory device such as random access memory (RAM) or a storage medium such as a hard disk drive (HDD) or a CD-ROM, but it is not limited to this. The storage 420*a* may be a memory implemented as a separate chip from the processor described above with respect to the controller 220, or may be implemented as a single chip with the processor.

The configuration of the controller 420 for controlling the speed of the motor 380 is the same as in FIG. 5, and the description thereof is omitted. In another embodiment, the first driver 430 of the washing machine may be the same as the driver 230 of the washing machine.

The second driver 440 operates the clutch in the first operation mode or the second operation mode based on the control command of the controller 260.

Figure 14:
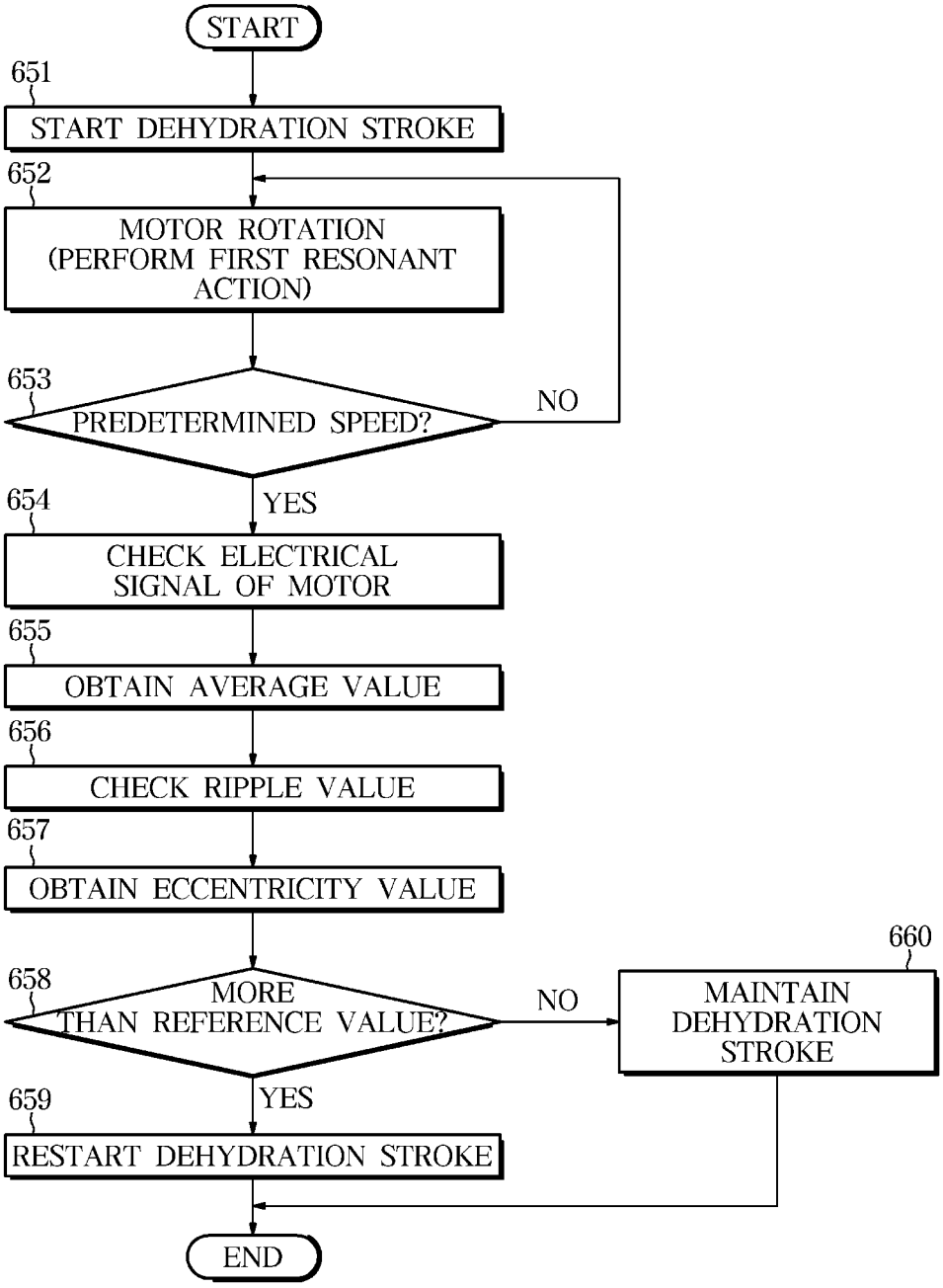
FIG. 14 is a control flowchart of a washing machine according to another embodiment.

FIG. 14 is a control flowchart of a washing machine according to another embodiment.

The washing machine 3 performs an operation based on at least one of a washing program and an option input to the input 451.

The washing machine 3 controls the operation of the water supplier 350 and the drain 370 and controls the operation of the motor 380 and the clutch 390 when the driving is performed, thereby performs washing stroke, rinsing stroke, dehydrating stroke, and drying stroke corresponding to at least one of the selected washing program and options.

The washing machine 3 displays performance information of the washing machine through the display 452 during driving.

The washing machine 3 determines whether an administration to be performed currently is a dehydration stroke based on at least one of the selected washing program and options, and starts a dehydration stroke when it is determined that the administration to be performed is a dehydration stroke (651).

The washing machine 3 senses the weight of the laundry contained in the rotating tub 330 at the start of the dehydration stroke.

The washing machine repeats the process of stopping the rotation of the motor 380 by a predetermined number of times after rotating the motor 380 to the first speed when detecting the weight of the laundry, and the weight of the laundry is detected based on the acceleration generated at this time.

Here, the first speed may be a speed at which the laundry is uniformly distributed in the rotating tub.

The washing machine determines the execution time of the dehydration stroke based on the detected laundry weight.

Here, determining the execution time of the dehydration stroke may include determining the execution time of the high speed rotation operation (SH, see FIG. 13).

It is also possible to determine the dehydration intensity of the dehydration stroke based on the detected laundry weight, Here, the dehydration intensity may be an intensity corresponding to the maximum speed of the motor (ie, the fifth speed).

The washing machine 3 may omit the weight sensing operation of the laundry during the dehydration stroke by checking the washing stroke or the weight of the laundry detected at the rinsing stroke.

The washing machine 3 controls the starting of the motor when the weight detection operation of the laundry is completed, and rotates the motor (652) when the starting of the motor 380 is completed, but increases the rotational speed of the motor to a preset speed. At this time, the washing machine performs a first resonant operation.

Here, the speed of the motor when performing the first resonant operation may be approximately 50 to 90 rpm.

The preset speed may be a speed between the speed of the motor in the first resonant operation and the speed of the motor in the second resonant operation at a second speed that is faster than the first speed.

The preset speed may be 150 rpm or slower than 150 rpm.

Also, the preset speed may be a speed of the motor before performing the second resonant operation.

Here, the first resonant operation and the second resonant operation are operation sections in which vibration starts to occur in the rotating tub by motor acceleration.

In addition, since the speed of the motor increases during the second resonant operation, more vibrations may be generated than during the first resonant operation.

Therefore, the washing machine 3 detects an eccentricity before vibration caused by motor acceleration occurs.

The washing machine 3 determines whether the speed of the motor 380 is a preset speed (653). If the speed of the motor 380 is determined to be a preset speed, the washing machine 3 maintains the speed of the motor at the preset speed, and checks the operation information of the motor for a certain time maintained at the preset speed.

Checking the operation information of the motor here includes checking (654) an electrical signal applied to the motor.

The electrical signal applied to the motor may include a current signal.

The electrical signal applied to the motor may be a voltage signal or a power signal.

The washing machine 3 acquires an average value of the electrical signals for a predetermined time (655), and checks the ripple value for the predetermined time (656).

When the washing machine checks the ripple value for a predetermined time, the washing machine checks the largest maximum ripple value among the ripple values of the ripple signal generated during the predetermined time.

In addition, when the washing machine checks the ripple value for a predetermined time, it is also possible to check the smallest minimum ripple value among the ripple values of the ripple signal generated during the predetermined time.

In addition, when the washing machine 3 checks the ripple value for a predetermined time, it is also possible to check the average ripple value of the ripple values of the ripple signal generated during the predetermined time.

The configuration for obtaining the average value of the electrical signal and checking the ripple value will be described in more detail.

As an example, a configuration of obtaining an average value of an electrical signal and checking a ripple value using a current signal applied to a motor will be described.

The washing machine 3 checks the current signal detected for a predetermined time by the current detector, recognizes the current value in the identified current signal, and obtains an average value for the recognized current value for a predetermined time.

When the washing machine 3 acquires an average value of the currents detected for a predetermined time, the washing machine 3 may obtain an average value of the currents by using the integration over time.

The washing machine 3 recognizes the ripple signal from the identified current signal and checks the current value of the recognized ripple signal. Here, the current value of the ripple signal corresponds to the ripple value of the current.

When the washing machine 3 checks the ripple value of the current, the washing machine 3 checks the highest ripple value having the largest value among the ripple values of the current detected for a certain time.

In addition, the washing machine 3 may check the smallest minimum ripple value among the ripple values of the current detected for a certain time, and may also check the average ripple value of the ripple values of the current detected for a certain time.

As another example, a configuration of obtaining an average value of an electrical signal and checking a ripple value using a voltage signal applied to a motor will be described.

The washing machine 3 checks the voltage signal detected for a predetermined time by the voltage detector and recognizes the voltage value from the checked voltage signal, and obtains the average value of the voltages of the recognized voltage values, and checks the ripple value of the identified voltage over the predetermined time.

When the washing machine 3 acquires an average value of the voltage values recognized for a predetermined time, the washing machine 3 may obtain the average value of the voltage by using the integration over time.

When the washing machine 3 checks the ripple value of the voltage, the washing machine 3 recognizes the ripple signal from the checked voltage signal and checks the voltage value of the recognized ripple signal. Here, the voltage value of the ripple signal corresponds to the ripple value of the voltage.

The washing machine 3 checks the highest ripple value having the largest value among the ripple values of the voltage checked for a certain time.

In addition, the washing machine 3 may check the smallest minimum ripple value among the ripple values of the voltage checked for a certain time, and may also check the average ripple value of the ripple values of the checked voltage for a certain time.

As another example, a configuration of obtaining an average value of an electrical signal and checking a ripple value by using a power signal applied to a motor will be described.

The washing machine 3 checks the current signal detected for a predetermined time by the current detector and the voltage signal detected for a predetermined time by the voltage detector.

The washing machine 3 recognizes the current value in the identified current signal, recognizes the voltage value in the voltage signal, and obtains a power value corresponding to the power signal of the motor for a predetermined time.

The washing machine 3 recognizes the current value in the identified current signal, recognizes the voltage value in the voltage signal, and obtains a power value corresponding to the power signal of the motor for a predetermined time.

The washing machine 3 obtains an average value of power values for a certain time.

When the washing machine 3 acquires an average value of power values recognized for a predetermined time, the washing machine 3 may obtain an average value of power using an integration over time.

The washing machine 3 acquires a power signal for a predetermined time by a current signal and a voltage signal for a predetermined time, recognizes a ripple signal from the obtained power signal for a predetermined time, and confirms a power value corresponding to the recognized ripple signal do. Herein, the power value corresponding to the ripple signal corresponds to the ripple value of power.

When the washing machine checks the ripple value of the power, the washing machine checks the highest ripple value having the largest value among the ripple values of the power for a certain time.

In addition, the washing machine may check the smallest minimum ripple value among the ripple values of the power for a certain time, and may determine the average ripple value of the ripple values of the power for a certain time.

The washing machine divides the average value of the obtained electrical signal by the identified ripple value to obtain an eccentric value (657).

The washing machine may obtain an eccentric value by selecting the highest ripple value among the ripple values of the electrical signal for a predetermined time and dividing the average value of the electrical signal by the selected highest ripple value.

In addition, the washing machine may obtain an eccentric value using a minimum ripple value or an average ripple value among the ladle values of the electrical signal.

Here, the eccentric value includes an eccentric value detected by the occurrence of the diagonal eccentricity.

The washing machine compares the obtained eccentricity value with the reference value, and if it is determined that the acquired eccentricity value is greater than or equal to the reference value, it determines that a diagonal eccentricity has occurred.

Next, the washing machine stops the dehydration stroke based on the determination of the diagonal eccentricity, and then performs the dehydrating stroke again from the beginning (659).

Through this, if it is determined that the diagonal eccentricity is severely generated during the eccentric sensing operation, the resonance operation may be prevented by stopping the dehydration stroke. Therefore, the vibration can be prevented from being severely generated in the washing machine, thereby preventing damage to the washing machine.

Re-executing the dehydration stroke from the beginning can be performed from the weight sensing operation.

Re-executing the dehydration stroke from the beginning can be performed from the first resonant operation.

The washing machine maintains the dehydration stroke (660) if it is determined that the obtained eccentric value is less than the reference value.

Maintaining the dehydration stroke may include performing a second resonant operation.

Maintaining the dehydration stroke may include performing a high speed rotational operation. In this case, the washing machine may increase the speed of the motor from the preset speed to the fifth speed for the dehydration operation. That is, the washing machine may also control the speed of the motor to rise to the fifth speed so that the present dehydration operation is performed.

As described above, the present embodiment can prevent entering into the transient section by early detecting the diagonal eccentricity in the low speed section. Accordingly, it is possible to reduce the magnitude of the vibration generated in the washing machine and to prevent the failure of the washing machine due to the vibration.

On the other hand, the disclosed embodiments may be implemented in the form of a recording medium for storing instructions executable by a computer. Instructions may be stored in the form of a program code, and when executed by a processor, may generate a program module to perform the operations of the disclosed embodiments. The recording medium may be implemented as a computer-readable recording medium.

The computer-readable recording medium includes all kinds of recording media having stored thereon instructions which can be read by a computer. For example, there may be read only memory (ROM), random access memory (RAM), a magnetic tape, a magnetic disk, a flash memory, an optical data storage device, and the like.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine, comprising:

a rotating tub configured to receive laundry;

a motor configured to apply a driving force to the rotating tub;

a detector configured to detect an electrical signal of the motor, the electrical signal being a current signal corresponding to a current flowing through the motor or a voltage signal corresponding to a voltage applied to the motor; and a controller configured to receive the electrical signal detected by the detector during a predetermined time when a speed of the motor during a dehydration stroke is a predetermined speed, obtain, based on the received electrical signal, an average value of the electrical signal received during the predetermined time, check a ripple value in the received electrical signal, obtain an eccentric value by dividing the obtained average value by the ripple value, identify a type of eccentricity as diagonal eccentricity or general eccentricity based on the obtained eccentric value, and control an operation of the motor to stop or maintain the dehydration stroke based on the identified type of eccentricity.

2. The washing machine of claim 1, wherein the type of eccentricity is identified as being diagonal eccentricity when the obtained eccentric value is equal to or larger than a predetermined value, and is identified as being general eccentricity when the obtained eccentric value is less than the predetermined value, when the type of eccentricity is identified as being diagonal eccentricity, the controller is configured to control the operation of the motor to stop the dehydration stroke, and when the type of eccentricity is identified as being general eccentricity, the controller is configured to control the operation of the motor to maintain the dehydration stroke.

3. The washing machine of claim 2, wherein, when the type of eccentricity is identified as being general eccentricity, the controller is configured to control the speed of the motor as an acceleration control for a resonance operation.

4. The washing machine of claim 2, wherein, when the type of eccentricity is identified as being general eccentricity, the controller is configured to control the speed of the motor to a speed for a high speed rotation operation to maintain the dehydration stroke.

5. The washing machine of claim 1, wherein the type of eccentricity is identified as being diagonal eccentricity when the obtained eccentric value is equal to or larger than a predetermined value.

6. The washing machine of claim 1, wherein the controller is configured to control the motor to detect a weight of laundry received in the tub, and to control the speed of the motor to a predetermined speed when the weight is detected.

7. The washing machine of claim 1, wherein the rotating tub is disposed horizontally inside a case and includes an inlet provided in a front of the rotating tub, and the controller is configured to control the speed of the motor during the dehydration stroke to be at the predetermined speed by accelerating the speed of the motor to the predetermined speed.

8. The washing machine of claim 1, wherein the rotating tub is disposed vertically inside a case and includes an inlet provided in an upper portion of the rotating tub, and, the controller is configured to control the speed of the motor during the dehydration stroke to be at the predetermined speed by accelerating the speed of the motor to the predetermined speed when a first resonant operation is completed and before performing a second resonant operation.

9. The washing machine of claim 8 wherein the speed of the motor when performing the second resonant operation is greater than the speed of the motor when performing the first resonant operation, and the predetermined speed is greater than the speed of the motor when performing the first resonant operation.

10. The washing machine of claim 1, wherein the ripple value includes a highest ripple value of ripple values of the electrical signal received during the predetermined time.

11. The washing machine of claim 1, wherein the predetermined speed includes a speed between 100 rpm and 150 rpm.

* * * * *